US011180278B2

(12) United States Patent
Bressan et al.

(10) Patent No.: US 11,180,278 B2
(45) Date of Patent: Nov. 23, 2021

(54) COUPLING SYSTEMS FOR TAMPER-EVIDENT CONTAINERS

(71) Applicant: I.G.B. S.r.l., Milan (IT)

(72) Inventors: Michel Bressan, Induno Olona (IT); Alessio Bressan, Varese (IT); Alberto Gandolla, Induno Olona (IT)

(73) Assignee: I.G.B. S.r.l., Milan (IT)

( * ) Notice: Subject to any disclaimer, the term of this patent is extended or adjusted under 35 U.S.C. 154(b) by 0 days.

(21) Appl. No.: 16/142,542

(22) Filed: Sep. 26, 2018

(65) Prior Publication Data

US 2019/0100346 A1 Apr. 4, 2019

(30) Foreign Application Priority Data

Sep. 29, 2017 (IT) ..... 102017000109512

(51) Int. Cl.

*B65D 5/10* (2006.01)
*B65D 5/66* (2006.01)
*B65D 5/02* (2006.01)

(52) U.S. Cl.

CPC ..... *B65D 5/106* (2013.01); *B65D 5/0254* (2013.01); *B65D 5/665* (2013.01); *B65D 5/6608* (2013.01); *B65D 2401/60* (2020.05)

(58) Field of Classification Search

USPC ..... 229/120, 148–153, 143, 122.32; 206/807
See application file for complete search history.

(56) References Cited

U.S. PATENT DOCUMENTS 3,949,931 A * 4/1976 Hall ..... B65D 5/22 229/102
5,507,428 A * 4/1996 Robinson, Jr. ..... B65D 5/0254 229/102
5,803,345 A * 9/1998 Jones ..... B65D 5/6608 206/807

FOREIGN PATENT DOCUMENTS

BE 410524 A 8/1935
EP 2239203 A 10/2010
WO WO2015170203 A 11/2015
WO WO-2015170203 A1 * 11/2015 ..... B65D 5/0254

OTHER PUBLICATIONS

Search Report for Italian Application No. IT201700109512, dated May 17, 2018, 7 pages.

* cited by examiner

*Primary Examiner* — Nathan J Newhouse
*Assistant Examiner* — Phillip D Schmidt
(74) *Attorney, Agent, or Firm* — Fish & Richardson P.C.

(57) ABSTRACT

A tamper-evident coupling system includes a first base portion, a second base portion, a first coupling portion supported by and extending from the first base portion, and a second coupling portion supported by the second base portion and configured for cooperating with the first coupling portion. The first and the second coupling portions are configured for defining an arming condition in which the first and second coupling portions are stably engaged with each other. At least one of the first and the second coupling portions includes a removable portion that is separable from the tamper-evident coupling system upon a first disengagement of the first and second coupling portions following the arming condition to prevent a subsequent coupling between the first and second coupling portions and to show a tampering with the tamper-evident coupling system.

9 Claims, 16 Drawing Sheets

COUPLING SYSTEMS FOR TAMPER-EVIDENT CONTAINERS

CROSS REFERENCE TO RELATED APPLICATIONS

This patent application claims priority under 35 U.S.C § 119 to Italian Patent Application No. 102017000109512, filed Sep. 29, 2017, the entire contents of which are incorporated herein by reference.

TECHNICAL FIELD

This disclosure relates to a tamper-evident coupling system and a process for the manufacturing thereof. Said coupling system is provided for defining containers, envelopes and/or bands for containing and/or wrapping products of various kind. The coupling system may find application in all the fields providing for the packaging of products and requiring a degree of security which enables to show a possible tampering of the package. For example, the coupling system may be employed in the fields of communication (for example, for postal services), transport and logistics.

BACKGROUND

The employment of packages—made of paper or plastic material—for products of various kind and equipped with security systems is defined as "tamper-evident". The demand for packages adapted to ensure the consumer the integrity of the product is, in fact, ever increasing: tamper-evident systems have the purpose of showing a first opening of the package, so as to warn of the danger of possible tampering of the product. For example, containers made of paper material are known which use, as tamper-evident system, adhesive labels positioned on the closure of the container and configured for preventing the opening of the latter without the previous removal of the label. Such containers, although equipped with a security system, are certainly more expensive with respect to conventional containers (containers without tamper systems) since they require additional raw materials, such as seals/labels, as well as additional steps for the preparation and application of such elements. Adhesive labels, however, do not enable the containers to be effectively tamper-proof; the labels may be easily removed by unsticking them, without such operation clearly damaging the package: following the opening of the container it is possible to tamper with the content and to reposition the same label removed—or a new label—on the closure of the container without the user being shown the occurred tampering of the product. Given the poor efficacy of the labels described above, tamper-evident containers made of paper material have been manufactured which do not require the application of additional seals to close the container itself.

A first example, described in patent application BE410524A, relates to a box made of paper material exhibiting a storage provided with an opening delimited by a free edge. The container also exhibits a closing tab engaged with the free edge of the storage and rotatably movable around the latter between a closed condition of the container, in which the tab occludes the opening of the storage, and an open condition in which the tab allows the passage of products from the opening of the storage. The closing tab bears an inserting portion adapted to be inserted inside the container in the closed condition thereof on the inserting portion, two folded flaps are defined opposite to each other, joined to the inserting portion by means of a weakened portion. The container also exhibits a coupling portion defined by a tab integrally joined to the free edge of the storage, V-folded inside the storage itself. On the tab—at the bottom of the V-shape—a pocket is defined adapted to receive, in the closed condition of the container, the inserting portion: in the closed condition, the flaps are configured for being inserted into the pocket and being constrained to the coupling portion so as to lock the closing tab onto the storage. Upon a first open condition of the container, the flaps are configured for detaching from the inserting portion.

The container described in the aforementioned application is an improvement with respect to the seal systems described above, at least in relation to product costs. In fact, the container described in such application is entirely made of paper material: the tamper-evident system consists of folded paper portions of the storage and of the closing tab: such containers are more cost-effective with respect to the containers requiring the use of additional material (for example, plastic film coatings and/or additional labels) and therefore additional process steps for the preparation and application of such material. However, it is noted that the tamper-evident security system of the application BE410524A, in the event of the container being previously tampered with, does not allow to clearly show it: the user must be capable of noticing the occurred tampering of the container exclusively on the basis of the perceived resistance offered at the opening of the container.

A second example, described in patent application WO2015170203A1 of the same Applicant, relates to a tamper-evident container of sheet material exhibiting a storage provided with an opening delimited by a free edge. The container includes a closing system associated with the free edge of the storage and rotatably movable around the latter between a closed condition of the container, in which the system occludes the opening of the storage, and an open condition in which the system allows the passage of products from the opening of the storage. The container includes a security device exhibiting a first coupling portion associated with the closing system and a second coupling portion arranged inside the storage; the first and the second coupling portions are configured for engaging under a first closed condition of the container. The security device further includes a removable portion defined by at least one between said first and second coupling portions; the removable portion is configured for breaking and separating from the container under a first opening condition of the latter immediately following the first closed condition. A through opening is present on the storage, enabling the display of the removable portion.

The container described in application WO2015170203A1 of the same Applicant is certainly an improvement with respect to the previous solutions described above, since—in addition to enabling an effective closure of the container without the use of additional seals—it is capable of clearly showing the occurred tampering of the container by virtue of the presence of the through opening on the storage, through which the lack of the removable portion of the security device may be immediately identified. However, the tamper-evident security devices known today—although widely used—may be further improved.

SUMMARY

It is therefore the object of the present invention to substantially solve at least one of the drawbacks and/or limitations of the previous solutions.

A first objective of the invention is to provide a coupling system which may effectively guarantee that tampering is shown at a first opening thereof; in particular, it is the object of the invention to provide a tamper-evident coupling system having a tamper-evident security system which is easily armable (activatable) under a first closed condition thereof. It is a further object of the invention to provide a coupling system of simple and rapid manufacturing, which enables to reduce product and production costs to a minimum. It is an additional object to provide a coupling system which is flexible in the use thereof, which may be effectively employed on different types of products, such as, for example, containers of sheet material (both made of paper and plastic), envelopes, product wrapping bands.

One or more of the objects described above and which will become more apparent in the course of the following description are substantially achieved by a tamper-evident coupling system, a manufacturing process and a use of the coupling system itself in accordance with one or more of the accompanying claims and/or of the following aspects, taken alone or in any combination thereof or in combination with any one of the accompanying claims and/or in combination with any of the further aspects or features described below.

A 1st aspect provides for a tamper-evident coupling system (1), optionally of sheet material, including:

at least one first base portion (11), at least one second base portion (12), at least one first coupling portion (13) borne by the first base portion (11), the first coupling portion (13) extends as a prolongation of the first base portion (11), at least one second coupling portion (14) borne by the second base portion (12) and configured for cooperating with said first coupling portion (13), the first and the second coupling portions (13, 14) being configured for defining at least one arming condition in which said first and second coupling portions (13, 14) are stably engaged with each other, in which at least one between the first and the second coupling portions (13, 14) includes at least one removable portion (15) configured for separating from the coupling system (1)—upon a first disengagement condition of said first and second coupling portions (13, 14) following said arming condition—to inhibit a following coupling of said first and second coupling portions (13, 14) to show a tampering of the coupling system (1).

In a 2nd aspect, in accordance with the 1st aspect, the second coupling portion (14) extends as a prolongation of the second base portion (12) starting from a perimetral edge (12*a*) of the latter.

In a 3rd aspect, in accordance with the 2nd aspect, the second coupling portion (14) includes at least one hook (22) defining at least one undercut portion delimited by a gripping edge (22*a*) facing the perimetral edge (12*a*) of the second base portion (12), the gripping edge (22*a*) of the hook (22) of the second coupling portion (14) defining, cooperatively with the perimetral edge (12*a*) of the second base portion (12), a passage (32) adapted to receive, when crossed, the first coupling portion (13) for the engagement of the latter with the second coupling portion (14).

In a 4th aspect, in accordance with any one of the preceding aspects, the second coupling portion (14) is integrally joined to the second base portion (12), said second coupling portion (14) and said second base portion (12) defining a single wall of sheet material.

In a 5th aspect, in accordance with any one of the preceding aspects, the second base portion (12) of sheet material extends in thickness between a first and a second surface, in which the second coupling portion (14) of sheet material also extends in thickness between a first and a second surface, wherein—at least under the arming condition of the first and second coupling portions (13, 14)—the first surface of the second coupling portion (14) seamlessly extends as a prolongation with respect to the first surface of the second base portion (12).

In a 6th aspect, in accordance with the preceding aspect, in which—at least under the arming condition of the first and second coupling portions (13, 14)—the second surface of the second coupling portion (14) seamlessly extends as a prolongation with respect to the second surface of the second base portion (12).

In a 7th aspect, in accordance with any one of the aspects from the second to the sixth, the second coupling portion (14)—at least before the arming condition of the first and second coupling portions (13, 14)—is rotatably movable with respect to the second base portion (12) around the perimetral edge (12*a*) of said second base portion (12).

In an 8th aspect, in accordance with any one of the aspects from the 2nd to the 7th, the second coupling portion (14) is rotatably movable around the perimetral edge (12*a*) of the second base portion (12) by an angle below 45°, in particular below 30°, even more in particular below 20°; said angle of rotation of the second coupling portion (14) being measured with respect to a central configuration of the second coupling portion (14) in which the same extends as a prolongation of, parallel to, the second base portion (12).

In a 9th aspect, in accordance with any one of the preceding aspects, the second coupling portion (14) is not facing the second base portion (12).

In a 10th aspect, in accordance with any one of the aspects from the 3rd the 9th, the second coupling portion (14) is defined solely by the respective hook (22) which is directly constrained to the second base portion (12).

In an 11th aspect, in accordance with any one of the aspects from the 3rd to the 10th, the hook (22) of the second coupling portion (14) includes a first and a second attachment edge (22*b*, 22*c*) opposite to each other and engaged with the perimetral edge (12*a*) of the second base portion (12), in which the gripping edge (22*a*) of the hook (22) of the second coupling portion (14) is interposed between said first and second attachment edges (22*a*, 22*b*).

In a 12th aspect, in accordance with the preceding aspect, the hook (22) of the second coupling portion (14) is rotatably movable around said first and second attachment edges (22*b*, 22*c*).

In a 13th aspect, in accordance with any one of the preceding aspects, the first base portion (11) of sheet material extends in thickness between a first and a second surface, in which the first coupling portion (13) of sheet material of the coupling device (1) also extends in thickness between a first and a second surface, in which the first surface of the first base portion (11) seamlessly extends with respect to the first surface of the first coupling portion (13), in which the second surface of the first base portion (11) seamlessly extends with respect to the second surface of the first coupling portion (13).

In a 14th aspect, in accordance with any one of the preceding aspects, the removable portion (15), defined on at least one between the first and the second coupling portions (13, 14), includes at least one undercut portion essentially defining a coupling edge adapted to receive in engagement the other of said second and/or first coupling portions (14, 13).

In a 15th aspect, in accordance with any one of the preceding aspects, the first coupling portion (13) includes at least one respective hook (23) defining at least one undercut portion delimited by a respective gripping edge (23*a*), said hooks (22, 23), respectively of the first and second coupling portions (13, 14), being configured for stably engaging with each other at least under the arming condition of the first and second coupling portions (13, 14), optionally said hooks (22, 23)—under the arming condition—exhibiting respective concavities facing each other.

In a 16th aspect, in accordance with the preceding aspect, the first coupling portion (13) includes at least one pair of said undercut portions delimited by a respective pair of said gripping edges (23*a*) and defining two respective hooks (23), said hooks (23) of the first coupling portion (13)—under the arming condition—being configured for engaging with the hook (22) of the second coupling portion (14).

In a 17th aspect, in accordance with any one of the aspects from the 3rd to the 16th, the removable portion (15) is defined by the hook (22) of the second coupling portion (14).

In an 18th aspect, in accordance with any one of the aspects from the 3rd to the 17th, the hook (22) of the second coupling portion (14) is constrained to the perimetral edge (12*a*) of the second base portion (12) by means of at least one weakening element (26), optionally by means of two weakening elements (26) opposite to each other and symmetric with respect to a mid-axis of the coupling system (1).

In a 19th aspect, in accordance with the 17th or the 18th aspect, the hook (22) of the second coupling portion (14) is constrained to the second base portion (12) exclusively by means of said at least one weakening element (26).

In a 20th aspect, in accordance with any one of the aspects from the 17th to the 19th, the removable portion (15) is rotatably movable around the weakening element (26).

In a 21st aspect, in accordance with any one of the aspects from the 17th to the 20th, the weakening element (26) includes at least a selected one of: one or more cuts passing through the sheet material, an incision of the sheet material, a local squashing of the sheet material.

In a 22nd, in accordance with any one of the aspects from the 3rd to the 21st, the first base portion (11) includes at least one displaying opening (31) arranged at the hook (23) of the first coupling portion (13), said displaying opening (31) being configured for enabling the display of at least part of the removable portion (15) at least under the arming condition of the first and second coupling portions.

In a 23rd, in accordance with the preceding aspect, the displaying opening (31) is configured for enabling the display of the weakening element (26) of the removable portion (15).

In a 24th aspect, in accordance with any one of the aspects from the 2nd to the 23rd, the second base portion (12) includes a through cavity (29) delimited by a cut edge (33) defined by part of the perimetral edge (12*a*), said cut edge (33) delimiting a depression of the second base portion (12), in which the second coupling portion (14) is at least partially counter-shaped and arranged inside said depression.

In a 25th aspect, in accordance with the preceding aspect, the hook (22) of the second coupling portion (14) is—at least under the arming condition—engaged in said depression.

In a 26th aspect, in accordance with the 24th or the 25th aspect, the hook (22) is engaged with at least part of said cut edge (33).

In a 27th aspect, in accordance with any one of the aspects from the 24th to the 26th, the through cavity (29) and the displaying opening (31) are facing each other, at least under the arming condition of the coupling system (1).

In a 28th aspect, in accordance with any one of the aspects from the 24th to the 27th, the cut edge (33) defined by the cavity (29) includes the first and the second attachment edge (22*b*, 22*c*) of the hook (22) of the second coupling portion (14).

In a 29th aspect, in accordance with any one of the aspects from the 24th to the 28th, the cut edge (33) defined by the cavity (29) provides for an insertion edge (33*b*), optionally counter-shaped to the gripping edge (22*b*) of the hook (22) of the second coupling portion (14), included between the two weakening elements (26) or between the first and the second attachment edge (22*b*, 22*c*) of the hook (22), said insertion edge (33*b*) defining—cooperatively with the gripping edge (22*a*) of the hook (22), the passage (32) adapted to receive, when crossed, the first coupling portion (13) for the engagement of the latter with the second coupling portion (14).

In a 30th aspect, in accordance with any one of the preceding aspects, the coupling system (1) includes at least one supporting portion (16) directly constrained to the second base portion (12), in which the supporting portion (16) is configured—at least during an initial step of contact between the first and the second coupling portions (13, 14) of the coupling system (1) preceding said arming condition—for sustaining at least part of said second coupling portion (14).

In a 31st aspect, in accordance with the preceding aspect, the supporting portion (16) includes, at a bottom area (20), a mutual coupling portion (17) overlapping and stably constrained to the at least one respective mutual coupling portion (18) of the second base portion (12).

In a 32nd aspect, in accordance with the preceding aspect, the supporting portion (16) includes a pressing portion (19) emerging from the bottom area (20) of the same supporting portion (16), said pressing portion (19) being configured for receiving against it, to sustain it, the second coupling portion (14).

In a 33rd aspect, in accordance with the preceding aspect, the pressing portion (19) is movable, in particular rotatably, with respect to the mutual coupling portion (17) of the supporting portion (16) itself.

In a 34th aspect, in accordance with the 32nd or the 33rd aspect, the pressing portion (19) is not directly constrained to the first coupling portion (13), to the second coupling portion (14), to the first base portion (11) and to the second base portion (12).

In a 35th aspect, in accordance with any one of the aspects from the 32nd to the 34th, the pressing portion (19) and the mutual coupling portion (17) of the supporting portion (16) are integrally joined defining a tab of sheet material.

In a 36th aspect, in accordance with any one of the aspects from 32nd to 35th, the mutual coupling portion (17) of the supporting portion (16) is defined at a bottom area (20) of the supporting portion (16), the pressing portion (19) emerging from the bottom portion (20) along a longitudinal development trajectory of the supporting portion (16).

In a 37th aspect, in accordance with any one of the aspects from 32nd to 36th, the supporting portion (16) includes at least one pair of said mutual coupling portions (17) arranged essentially at longitudinally opposite end portions of the same supporting portion (16), optionally the pair of mutual coupling portions (17) symmetrically extend with respect to the longitudinal development trajectory, optionally the pressing portion (19) of the supporting portion (16) symmetrically extends with respect to the longitudinal development trajectory.

In a 38th aspect, in accordance with any one of the aspects from 32nd to 37th, the mutual coupling portion (17), optionally each mutual coupling portion, of the supporting portion (16) is fastened by means of adhesive material, in particular it is stuck, to the second base portion (12).

In a 39th aspect, in accordance with any one of the aspects from 32nd to 38th, the mutual coupling portion (17) of the supporting portion (16) is exclusively and directly engaged, in particular stuck, with the second base portion (12).

In a 40th aspect, in accordance with any one of the aspects from 32nd to 39th, the supporting portion (16) is integrally joined to the second base portion (12).

In a 41st aspect, in accordance with any one of the aspects from 32nd to 40th, the supporting portion (16) includes a weakening portion (24) configured for enabling the supporting portion (16) to define at least the following operating condition:

a holding operating condition—defined during an initial step of the arming condition under which the first coupling portion (13) rests against the second coupling portion (14)—in which the weakening portion (24) is intact and enables the supporting portion (16) itself to sustain the second coupling portion (14) limiting the movement thereof, a releasing operating condition—defined at least under the arming condition—in which the total or partial breaking of the weakening portion (24) occurs, so that the supporting portion (16) may enable a greater movement of the second coupling portion (14) with respect to the holding operating condition, said weakening portion (24) being configured for enabling the passage of the supporting portion (16) from the holding operating condition to the releasing one during the definition of the arming condition of the coupling system (1).

In a 42nd aspect, in accordance with any one of the aspects from 32nd to 41st, the supporting portion (16) is directly constrained, for example, by means of an adhesive or glue, to the second surface of the second base portion (12).

In a 43rd aspect, in accordance with the preceding aspect, the supporting portion (16), under the holding operating condition, exerts a pressure on the second coupling portion (14) to increase a flexural stiffness thereof.

In a 44th aspect, in accordance with the 42nd or the 43rd aspect, the supporting portion (16)—under the holding operating condition—is configured for receiving the hook (22) of the second coupling portion (14) against it, to limit a rotation of said hook (22) nearing the supporting portion (16) itself.

In a 45th aspect, in accordance with any one of the aspects from the 42nd to the 44th, the supporting portion (16), under the holding operating condition—is configured for enabling an angular displacement of the hook (22) of the second coupling portion (14) below 90°, in particular from 0° to 70°, even more in particular from 0° to 45°; said angular displacement is understood as the relative rotation of the hook (22) considered between an initial position of the hook (22)—before the holding operating condition—essentially aligned with the second base portion (12) and a final position which said hook (22) may assume under the holding operating condition.

In a 46th aspect, in accordance with any one of the aspects from the 42th to the 45th, the supporting portion (16), under the releasing operating condition—is configured for enabling an angular displacement of the hook (22) of the second coupling portion (14) greater than the angular displacement enabled under the holding operating condition.

In a 47th aspect, in accordance with any one of the aspects from the 42nd to the 46th, the supporting portion (16) is configured for counteracting the flexion of at least part of the second coupling portion (14) under the holding operating condition, in particular during the engagement step between the first and the second coupling portion (13, 14), in particular, the supporting portion (16) is configured for counteracting the flexion of the hook (22) of the second coupling portion (14) under the holding operating condition.

In a 48th aspect, in accordance with any one of the preceding aspects, under the arming condition, the first surface of the first coupling portion (13) faces, optionally at least partially being in contact, the second surface of the second base portion (12).

In a 49th aspect, in accordance with any one of the preceding aspects, under the arming condition—the second surface of the first base portion (11) faces, optionally at least partially being in contact, the first surface of the second coupling portion (14).

In a 50th aspect, in accordance with any one of the preceding aspects, the coupling system includes at least one through opening (28) defined on the first base portion (11) which is configured—under the arming condition—for enabling the display of at least part of the removable portion (15).

In a 51st aspect, in accordance with the preceding aspect, the second coupling portion (14), in particular, the removable portion (15), includes at least one projection (30) which is configured for crossing—at least under the arming condition—at least partially, the through opening (28) defined on the first base portion (11), said through opening (28) being configured for enabling the tactile perception of the projection (30) of the removable portion (15) under the arming condition.

In a 52nd aspect, in accordance with the 50th or the 51st aspect, the through opening (28) defines a closed perimetral profile exhibiting at least a selected one from the group of circular, rectangular, trapezoidal, semi-circular shapes or a combination thereof.

In a 53rd aspect a tamper-evident container (100) is provided for, including:

at least one storage (2) of sheet material defining an internal volume (3) and configured for housing products, said storage (2) exhibiting a predetermined number of lateral walls (4) defining at least one passage opening (5) delimited by a free edge (6), said passage opening (5) being configured for putting in communication the internal volume (3) of the storage (2) with the external environment, at least one coupling system (1) in accordance with any one of the preceding aspects, in which the first base portion (11) is rotatably constrained to the free edge (6) of the storage (2), the first coupling portion (13) is borne by the first base portion (11) so that the latter is interposed between the free edge (6) of the storage (2) and the first coupling portion (13), in which the first base portion (11) and the first coupling portion (13) are movable, in particular, at least rotatably, with respect to the storage (2), at least between:

a closed condition of the container (100) in which at least part of the first base portion (11) interdicts the communication between the internal volume (3) of the storage (2) and the external environment, an open condition of the container (100) in which the first base portion (11) and the first coupling portion (13) enable the communication between the internal volume (3) and the external environment, wherein the second base portion (12), jointly with the second coupling portion (14) of the coupling system (1) define at least part of a lateral wall (4) of the storage (2), wherein the coupling system (1)—under a first closed condition of the container (100)—is configured for defining the arming condition in which the first and the second coupling portions (13, 14) are engaged with each other, in which the coupling system (1)—under a first open condition of the container (100) following the first closed condition—is configured for defining a first disengagement condition under which the removable portion (15) is configured for separating from the coupling system (1) to show a tampering of the coupling system (1) itself and therefore of the container (100).

In a 54th aspect, in accordance with the preceding aspect, the first coupling portion (13)—under the arming condition and therefore under the first closed condition of the container (100)—is arranged, optionally entirely, in the internal volume (3) of the storage (2).

In a 55th aspect, in accordance with the 53rd or the 54th aspect, the hook (22) of the second coupling portion (14)—under the arming condition and therefore under the first closed condition of the container (100)—is arranged at least partially in the internal volume (3) of the storage (2) and facing at least one between the first base portion (11) and the first coupling portion (13).

In a 56th aspect, in accordance with any one of the aspects from the 53rd to the 55th, the hook (22) of the second coupling portion (14)—during the passage of the container (100) from the open condition to the first closed condition of the container—is configured for rotating with respect to a lateral wall (4) of the storage (2) according to a direction entering the internal volume (3) of the storage (2) so that the gripping edge (22*a*) of the hook (22) of the second coupling portion (14) may define—cooperatively with a lateral wall (4) of the storage (2)—the passage (32) adapted to receive, when crossed, the first coupling portion (13) for the engagement of the latter with the second coupling portion (14).

In a 57th aspect, in accordance with any one of the aspects from the 53rd to the 56th, the supporting portion (16) is also arranged in the internal volume (3) of the storage (2).

In a 58th aspect, in accordance with any one of the aspects from the 53rd to the 57th, the supporting portion (16) is constrained to the lateral wall (4) of the storage (2) bearing the second coupling portion (14).

In a 59th aspect, in accordance with any one of the aspects from the 53rd to the 58th, the first coupling portion (13)—under the arming condition and therefore under the first closed condition of the container (100)—is interposed between the supporting portion (16) and the lateral wall (4) of the storage (2) directly bearing the second coupling portion (14).

In a 60th aspect, in accordance with any one of the aspects from the 53th to the 59th, the hook (22) of the second coupling portion (14) defines the removable portion (15) which is directly constrained to an end edge of the lateral wall (4) of the storage (2), the removable portion (15) is connected at the head thereof to an end edge of the lateral wall (4) of the storage (2) defining a prolongation of the latter, the removable portion (15) being connected to said lateral wall (4) by means of the weakening element (26).

In a 61st aspect, in accordance with any one of the aspects from the 53rd to the 60th, the displaying opening (31) of the first base portion (13) is configured for enabling the display—from the outside of the storage (2)—of at least one between the weakening element (26) and at least one part of the removable portion (15)—at least under the first closed condition of the container.

In a 62nd aspect, in accordance with any one of the aspects from the 53rd to the 61st, the displaying opening (31) of the first base portion (13) is configured—upon the first open condition of the container (100)—for enabling the display of at least part of the internal volume (3) of the storage (2) so that the user may visually—from the outside of the storage (2)—verify at least one of the following conditions:

the absence of the removable portion (15), the breaking of the weakening element (26) adapted to connect the removable portion (15) to the storage (2).

In a 63rd aspect, in accordance with any one of the aspects from the 53rd to the 62nd, the first base portion (11) includes:

a closing portion (7) directly engaged with the free edge (6) of the storage (2) and movable, in particular rotatably, with respect to the latter, at least one inserting portion (8) configured for being inserted, under the closed condition of the container (100), inside the internal volume (3) of the storage (2), in which the first coupling portion (13) extends as a prolongation of the first base portion (11) from the opposite part to the storage (2), in which, under the first closed condition of the container (100) and therefore under the arming condition of the coupling system (1), the first and the second coupling portions (13, 14) are engaged with each other in the internal volume (3) of the storage (2).

In a 64th aspect, in accordance with the preceding aspect, the closing portion (7) and the inserting portion (8) of the first base portion (11) are integrally joined defining a closing tab (9) of the container (100) made of sheet material, for example paper.

In a 65th aspect, in accordance with the 63rd or the 64th aspect, at least one between the closing portion (7) and the inserting portion (8) includes the through opening (28).

In a 66th aspect, in accordance with any one of the aspects from the 63rd to the 65th, the inserting portion (8)—under the first closed condition of the container—is arranged above the removable portion (15) so that the latter is arranged at least partially in the internal volume (3) of the storage (2).

In a 67th aspect, in accordance with any one of the aspects from 63rd to the 66th, the displaying opening (31) is defined on the inserting portion (8), said displaying opening (31) being configured for being arranged, at least under the first closed condition of the container, at the removable portion (15) and being configured for enabling the display of the latter from the outside of the storage (2).

In a 68th aspect, a process is provided for, for the manufacturing of a coupling system (1) in accordance with any one of the aspects from the first to the fifty-second.

In a 69th aspect, in accordance with the preceding aspect, said process includes at least the following steps:

preparing the first base portion (11), preparing the first coupling portion (13), preparing the second base portion (12), preparing the second coupling portion (14), preparing the removable portion (15) on at least part of the first and/or second coupling portion (13, 14), wherein the step of preparing the second coupling portion (14) provides for constraining said portion to a perimetral edge (12*a*) of the second base portion (12) so that the second coupling portion (14) may be placed, at the head thereof, at the second base portion (12) and may extend as a prolongation of the latter, the gripping edge (22*a*) of the hook (22) of the second coupling portion (14) facing the perimetral edge (12*a*) of the second base portion (12), the gripping edge (22*a*) of the hook (22) of the second coupling portion (14) defining, cooperatively with the perimetral edge (12*a*) of the second base portion (12), a passage (32) adapted to receive, when crossed, the first coupling portion (13) for the engagement of the latter with the second coupling portion (14).

In a 70th aspect, in accordance with the preceding aspect, the step of preparing the first base portion (11) includes:

a step of preparing a first sheet (51) on a plane surface, a step of cutting the first sheet (51) defining the first base portion (11).

In a 71st aspect, in accordance with the 69th or the 70th aspect, the step of preparing the first coupling portion (13) includes:

a step of preparing a second sheet (52) on a plane surface, a step of cutting the second sheet (52) defining the first coupling portion (13), in particular, said cutting step defining the respective hook (23) of the first coupling portion (13), even more in particular, said cutting step defining the gripping edge (23*a*) delimiting an undercut portion of the first coupling portion (13).

In a 72nd aspect, in accordance with any one of the aspects from the 69th to the 71st, the step of preparing the second base portion (12) includes:

a step of preparing a third sheet (53) on a plane surface, a step of cutting the third sheet (53) defining the second base portion (12).

In a 73rd aspect, in accordance with any one of the aspects from the 69th to the 72nd, the step of preparing the second coupling portion (14) includes:

a step of preparing a fourth sheet (54) on a plane surface, a step of cutting the fourth sheet (54) defining the second coupling portion (14), in particular, said cutting step defining the hook (22) of the second coupling portion (14), even more in particular, said cutting step defining the gripping edge (22*a*) delimiting an undercut portion of the second coupling portion (14).

In a 74th aspect, in accordance with any one of the aspects from the 69th to the 73rd, the step of preparing the supporting portion (16) includes the following sub-steps:

preparing a fifth sheet (55) on a plane surface, cutting the fifth sheet (55) defining the supporting portion (16), in particular said cutting step defining the mutual coupling portion (17) and the pressing portion (19), constraining the supporting portion (16) to the second base portion (12) so that the pressing portion (19) of the supporting portion (16) is adjacent to the hook (22) of the second coupling portion (14), in particular adjacent to the removable portion (15) defined by said hook (22) of the second removable portion (14).

In a 75th aspect, in accordance with the preceding aspect, the step of cutting the fifth sheet (55) defines the weakening portion (24) configured for allowing the supporting portion (16) the passage from the holding condition to the releasing one during the definition of the arming condition of the coupling system (1).

In a 76th aspect, in accordance with any one of the aspects from the 69th to the 75th, the step of preparing the removable portion (15) includes a step of cutting the second (52) or fourth sheet (54) defining the weakening element (26) of the removable portion (15).

In a 77th aspect, in accordance with any one of the aspects from the 69th to the 76th, the cutting step provides for at least one operation between: punching, engraving, shearing, laser cutting.

In a 78th aspect, in accordance with any one of the aspects from the 69th to the 77th, the first and the second sheets (51, 52) are integrally joined to form a single body, in which the first coupling portion (13) extends seamlessly, as a prolongation, from the first base portion (11).

In a 79th aspect, in accordance with any one of the aspects from the 69th to the 78th, the third and the fourth sheet (53, 54) are integrally joined to form a single body, in which the second coupling portion (14) extends seamlessly, as a prolongation, from the second base portion (11).

In an 80th aspect, in accordance with any one of the aspects from the 69th to the 79th, the step of preparing the second base portion (12) and the second coupling portion (14) occurs simultaneously by means of the following sub-steps:

preparing a single sheet in accordance with a plane configuration, cutting said single sheet to delimit the second base portion (12) and part of the second coupling portion (14), said cutting step being adapted to delimit at least part of the hook (22) of the second coupling portion (14) integrally joined to the second base portion (12), optionally, realizing the weakening element (26) between the hook (22) of the second coupling portion (14) and the second base portion (12) so that said hook (22) may define the weakening portion (15).

In an 81st aspect, in accordance with any one of the aspects from the 69th to the 80th, the first, second, third, fourth and fifth sheet are integrally joined and entirely made of paper sheet material.

In an 82nd aspect, a process is provided for, for manufacturing a container (100) in accordance with any one of the aspects from the 53rd to the 67th.

In an 83rd aspect, in accordance with the preceding aspect, said process including at least the following steps:

preparing the storage (2), preparing the coupling system (1) so that:

the first base portion (11) and the first coupling portion are borne by the free edge (6) of the storage (2) and are rotatably movable with respect to the latter, the second base portion (12), jointly with the second coupling portion (14) define at least part of a lateral wall (4) of the storage (2).

In an 84th aspect, in accordance with the preceding aspect, the preparation of the coupling system (1) occurs by means of the process in accordance with any one of the aspects from the sixty-eighth to the eighty-first.

In an 85th aspect, in accordance with any one of the aspects from the 82nd to the 84th, the step of preparing the storage (2) includes at least the following sub-steps:

preparing a sixth sheet (56) including at least one first and one second portion (57, 59) interconnected by a central connecting portion (58), said sixth sheet (56) further including at least one first and one second lateral connecting portion (60, 61), said central connecting portion (58) being interposed between the first and the second portion (57, 59), the first portion (57) being interposed between the first lateral connecting portion (61) and the central connecting portion (58), the second portion (59) being interposed between the second lateral connecting portion (60) and the central connecting portion (58), each of said portions (57, 58, 59, 60, 61) including at least two opposite longitudinal edges and two opposite end edges, said first and second portions (57, 59), central connecting portion (58) and said lateral connecting portions (60, 61) being joined along the longitudinal edges and aligned along a single connection direction, folding said sixth sheet (56), joining said lateral connecting portions (60, 61), to form the storage (2) exhibiting the passage opening (5) delimited by the free edge (6), preparing a seventh sheet (62) exhibiting at least one portion (63) connected to at least one central and/or lateral connecting portion of the sixth sheet (56) and emerging with respect to the latter, folding the portion (63) of the seventh sheet (62) to form a resting portion (80) of the container (100), folding the first base portion (11) and the first coupling portion (13) of the first and second sheets (51, 52) to form the closing portion (7) and the inserting portion (8), respectively, of the closing tab (9).

In an 86th aspect, in accordance with any one of the aspects from the 82nd to the 85th, the third sheet (53) defining the second base portion (12) of the coupling system (1) is integrally joined to form a single body with the first portion (57) and/or with the second portion (59) of the sixth sheet (56).

In an 87th aspect, in accordance with any one of the aspects from the 82nd to the 86th, the first sheet (51) defining the first base portion (11) of the coupling system (1) is integrally joined to form a single body with the first and/or with the second portion (57, 59) of the sixth sheet (56), in particular in which said first sheet (51) emerges from the end edges of the sixth sheet (56).

In an 88th aspect, a process is provided for, for the arming of the coupling system (1) in accordance with any one of the aspects from the first to the fifty-second, said process including the following steps:

nearing the first coupling portion (13) and the second coupling portion (14) so that the first coupling portion (13) may rest against the second coupling portion (14), during the nearing step, passing the first coupling portion (13) through the passage (32) defined by the gripping edge (22*a*) of the hook (22) of the second coupling portion (14) cooperatively with the perimetral edge (12*a*) of the second base portion (12), engaging the first and the second coupling portions (13, 14) defining the arming condition.

In an 89th aspect, in accordance with the preceding aspect, the step of nearing the first and the second coupling portions (13, 14) includes the following sub-steps:

nearing the hook (23) of the first coupling portion (13) to the hook (22) of the second coupling portion (14), putting in contact, optionally pressing, the respective hook (23) of the first coupling portion (13) at the hook (22) of the second coupling portion (14), in particular, so that the respective hook (23) is interposed between the hook (22) of the second coupling portion (14) and the second base portion (12).

In a 90th aspect, in accordance with the 88th or the 89th aspect, the step of nearing the first and the second coupling portions (13, 14) includes a step of resting the pressing portion (19) against the hook (22) of the second coupling portion (14), so that the supporting portion (16) may sustain the hook (22) of the second coupling portion (14) and define the holding operating condition of the supporting portion (16).

In a 91st aspect, in accordance with any one of the aspects from the 88th to the 90th, the step of engaging the first and the second coupling portions (13, 14) includes the following steps:

inserting the respective hook (23) of the first coupling portion (13) at the gripping edge (22*a*) of the hook (22) of the second coupling portion (14), defining the grip between the undercut portions of the first and of the second coupling portion (13, 14) respectively delimited by the gripping edges (23*a*, 22*a*) defining the releasing operating condition, in particular, in which the breaking of the weakening portion (24) of the supporting portion (16) occurs, enabling an upper movement of the hook (22) of the second coupling portion (14) with respect to the holding operating condition.

In a 92nd aspect, in accordance with any one of the aspects from the 88th to the 91st, the process includes a step of closing the storage (2) so as to interdict the mutual communication between the internal volume (3) of the storage (2) and the external environment, said closing step including:

folding the closing portion (7) in rotation with respect to the free edge (6) of the storage (2), folding the hook (22) of the second coupling portion (14) towards the inside of the storage (2), passing the first coupling portion (13) through the passage (32) defined by the gripping edge (22*a*) of the hook (22) of the second coupling portion (14) and the perimetral edge (12*a*) of the second base portion (12), inserting said first coupling portion (13), optionally entirely, in the internal volume (3) of the storage (2) so as to define the coupling between the first and the second coupling portions (13, 14).

In a 93rd aspect, a use is provided for of the coupling system (1) in accordance with any one of the aspects from the 1st to the 52nd to define at least one selected from the group of: a container for the containment of one or more products, an envelope for the containment of one or more products, a band for wrapping one or more products.

DESCRIPTION OF THE DRAWINGS

Some embodiments and some aspects of the invention are described below with reference to the accompanying drawings, provided by way of indication and therefore not by way of limitation, in which.

DEFINITIONS

Figure 1:
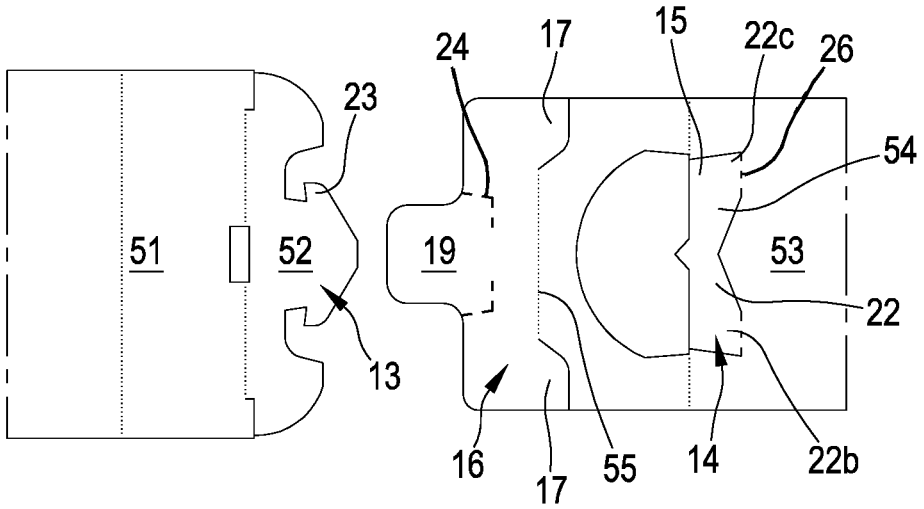
FIGS. 1 and 2 are plane views of a coupling system in accordance with the present invention respectively arranged under a fully extended condition and a partially extended condition (a part of the coupling system is folded)

In the present detailed description, corresponding parts shown in the various Figures are indicated with the same reference numerals. The Figures may show the object of the invention by means of not-to-scale representations; therefore, parts and components shown in the Figures relating to the object of the invention may exclusively relate to diagrammatic representations.

The term product means an item or a mixture of items of any kind. The term product may also mean a package, for example, bearing a plurality of items.

The term paper material means paper or cardboard, optionally having at least 50% by weight, preferably at least 70% by weight, of organic material including one or more between cellulose, hemicellulose, lignin, lignin derivatives. The paper sheet material may have a grammage from 50 to 500 g/m$^2$, in particular from 200 to 400 g/m$^2$. The paper material extends between a first and a second prevalent development surface. The paper sheet material may be coated for at least one part of the first and/or second prevalent development surface, by means of a coating made of plastic material, for example a film, whose purpose is to reinforce the paper material. The coating may also be employed to define a sort of water and/or humidity barrier, useful to avoid the weakening and loss of structurality of the coupling system (optionally, of the container, the envelope or the band) with consequent uncontrolled deformation of the paper material constituting the latter component. The coating may be applied to the paper material in the form of a so-called "coating paint" or lacquer deposited by solution or sprayed, whose thickness is generally from 0.2 to 10 μm. Alternatively, the coating may include a plastic film, for example, a polyethylene lining, which may be applied by means of a rolling process, on one or both sides of the paper material. In case the coating is applied by rolling, the values of the plastic film (coating) may, for example, vary from 5 to 400 μm of coating material (i.e., polyethylene). The plastic coating material may be selected, by way of explanation, from the following materials: PP, PE (HDPE, LDPE, MDPE, LLDPE), EVA, polyesters (including PET and PETg), PVdC. The possibility of manufacturing the coupling system (optionally the container, the envelope or the band) at least partially in plastic sheet material or, alternatively, at least partially in plastic material and partially in paper material, is not excluded.

The term container element means a container. The term envelope element means an envelope. The term band element means a band.

DETAILED DESCRIPTION

Tamper-Evident Coupling System 1

Reference numeral 1 overall indicates a tamper-evident coupling system of sheet material, for example, of paper material, associable to packages of various kinds—for example, containers, envelopes or bands also made of sheet material—for the containment and/or wrapping of products.

The coupling system 1 includes a first base portion 11, a second base portion 12, a first coupling portion 13 borne by the first base portion 11, a second coupling portion 14 borne by the second base portion 12 and configured for cooperating with the first coupling portion 13. The first and the second coupling portions 13, 14 are configured for defining at least one arming condition in which the first and second coupling portions 13, 14 are stably engaged with each other (see FIGS. 8-9, 23-24). The first base portion 11, shown, for example, in FIGS. 1-3, includes a body of sheet material, optionally paper, joined to the first coupling portion 13 at an end portion of the first base portion 11: such portions 11, 13 are engaged with each other, essentially defining a single perimetral edge. In particular, the first coupling portion 13 is integrally joined to the first base portion 11 and extends as a prolongation, seamlessly, with respect to said first base portion 11: the first base portion 11 and the first coupling portion 13 are joined defining a single body (sheet).

Figure 2:
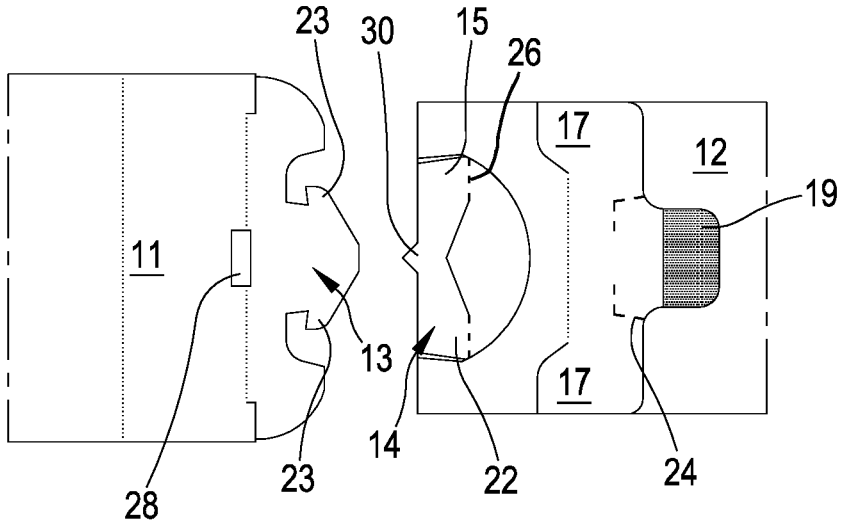
Figure 3:
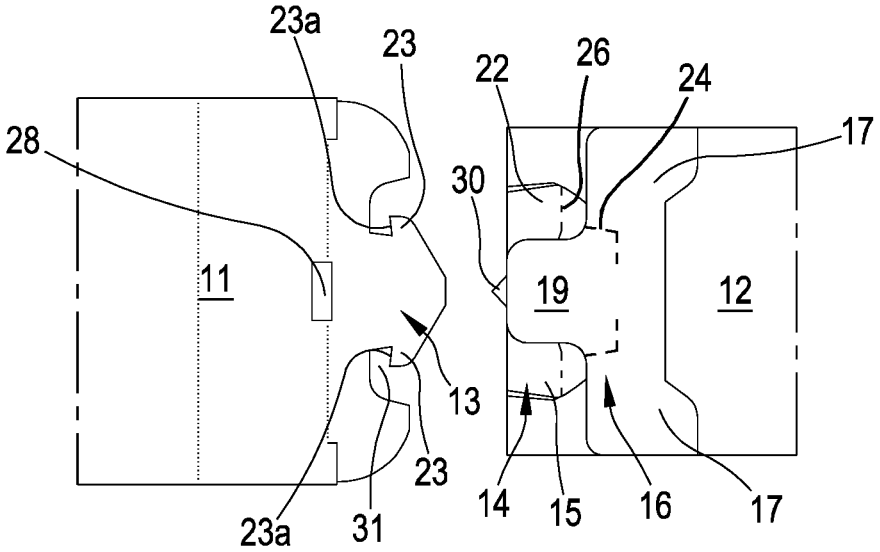
FIG. 3 is a plane view of a coupling system in accordance with the present invention.
Figure 4:
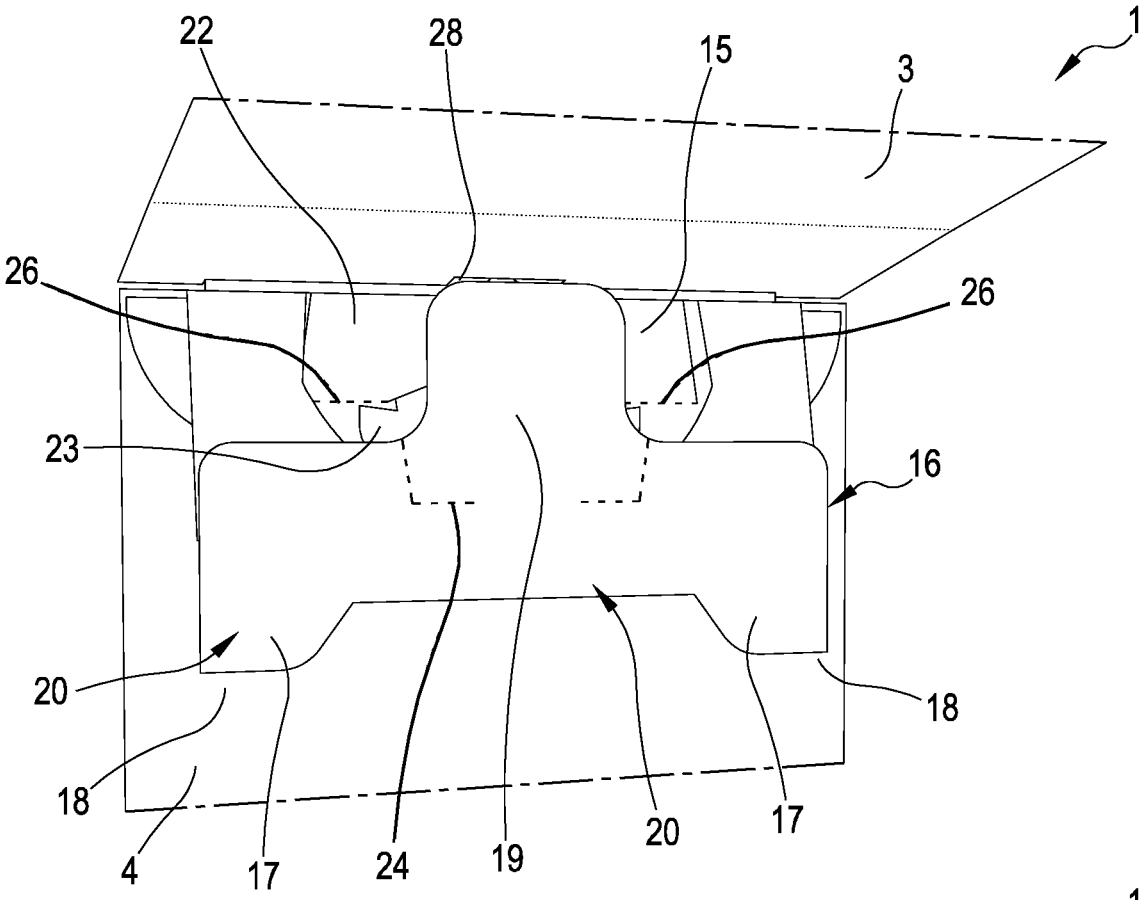
FIGS. 4-5 are perspective views of a coupling system in accordance with the present invention.

The first coupling portion 13, as shown in the accompanying FIGS. 1-3, exhibits a substantially arrow-like or trapezoidal shape. The possibility of manufacturing a first coupling portion 13 exhibiting a different shape, for example triangular or rectangular, is not excluded. The first coupling portion 13 is also made of sheet material, for example of paper sheet material, in particular of the same material of the first base portion 11.

As shown, for example, in FIGS. 1-3, 5A-B, 6A-B, the first coupling portion 13 includes at least one hook 23 defining at least one undercut portion delimited by a respective gripping edge 23*a*. The first coupling portion 13 may exhibit two respective hooks 23, symmetric to each other with respect to a mid-axis of the first coupling portion 13 and defining respective gripping edges 23*a*. The first coupling portion 13 includes at least one displaying opening 31 (FIGS. 3, 5A-5B) arranged at the hook 23. In particular, the displaying opening 31 is delimited, at least partially, by the respective gripping edge 23*a* of the hook 23.

The coupling system 1 includes at least one through opening 28 (FIGS. 1-3) defined on the first base portion 11 and/or on the first coupling portion 13 (see also FIGS. 5B-13, 17-24). The through opening 28 exhibits a rectangular shape, optionally it may exhibit a circular, trapezoidal, triangular shape or a combination thereof with a closed profile. The through opening 28 may be arranged at an end portion between the first base portion 11 and the first coupling portion 13.

The second base portion 12 (FIGS. 1-3) also includes a body of sheet material, optionally paper, extending in thickness between a first and a second surface. The second base portion 12 stably bears the second coupling portion 14. In greater detail, the second coupling portion 14 is engaged at an end portion of the second base portion 12, so as to define a single wall of sheet material. In detail, the second coupling portion 14, shown in FIGS. 1-3, extends in thickness between a first and a second surface; at least under the arming condition of the first and second coupling portions 13, 14, the first surface of the second coupling portion 14 seamlessly extends as a prolongation with respect to the first surface of the second base portion 12. Under the same arming condition, the second surface of the second coupling portion 14 seamlessly extends as a prolongation with respect to the second surface of the second base portion 12.

The second coupling portion 14 extends as a prolongation of the second base portion 12 starting from a perimetral edge 12*a* defined at an end portion of the second base portion 12 itself (see FIGS. 5A, 5B, 6A, 6B). Consequently, the second coupling portion 14 is not facing any surface of the second base portion 12: the second coupling portion 14 emerges from at least part of the perimetral edge 12*a* of the second base portion 12.

The second coupling portion 14, at least before the arming condition of the first and second coupling portions 13, 14, is rotatably movable with respect to the second base portion 12, in particular around the perimetral edge 12*a* of the second base portion 12, from which the second coupling portion 14 extends as a prolongation. In detail, the second coupling portion 14 is rotatably movable (see FIGS. 7 and 24) around the perimetral edge 12*a*, optionally by an angle below 45°, in particular below 30°, even more in particular below 20°. This angle of rotation of the second coupling portion 14 around the perimetral edge 12*a* is measured with respect to a central configuration, shown in FIG. 5A, of the second coupling portion 14 in which the same extends as a prolongation of, parallel to, the second base portion 12. The second coupling portion 14 may exhibit freedom of rotation nearing both the first and the second surface of the second base portion 12. The second coupling portion 14 includes at least one hook 22 (FIGS. 1-7, 17-18) exhibiting a substantially C- or V-shape. Alternatively, the hook 22 may exhibit a rectangular, trapezoidal, circular, semi-circular shape or a combination thereof. The hook 22 defines an undercut portion delimited by a gripping edge 22*a*. The second coupling portion 14 may include a single undercut portion defining a single hook 22 exhibiting in turn a single continuous gripping edge 22*a*. In detail, the second coupling portion 14 is exclusively defined by the respective hook 22 which is directly constrained to the second base portion 12. In particular, the hook 22 extends as a prolongation from the perimetral edge 12*a* of the second base portion 12 defining a single wall; In particular, the hook 22 extends as a prolongation.

Figure 5:
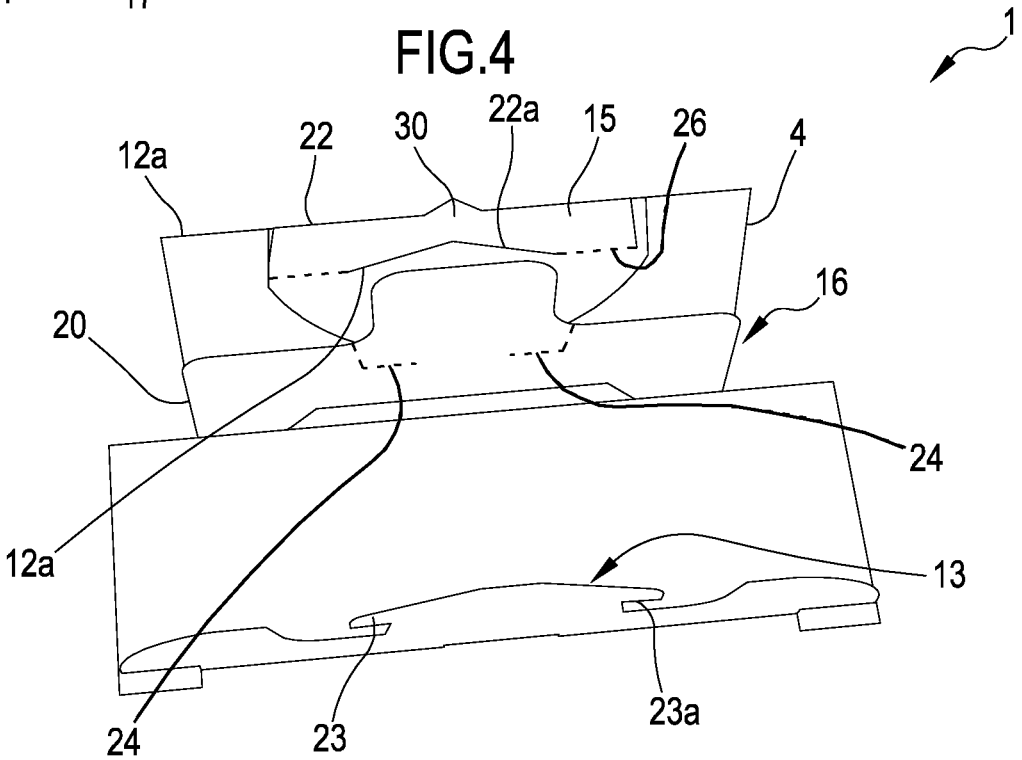
Figure 5A:
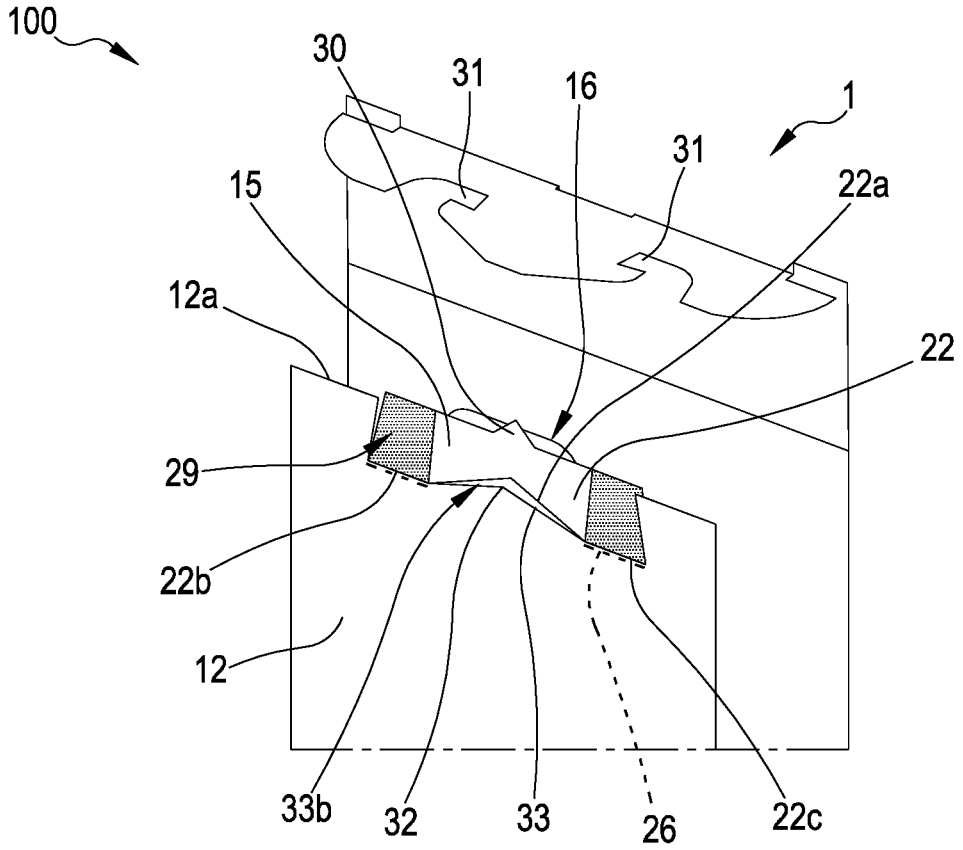
FIG. 5A shows a coupling system under an open condition.
Figure 5B:
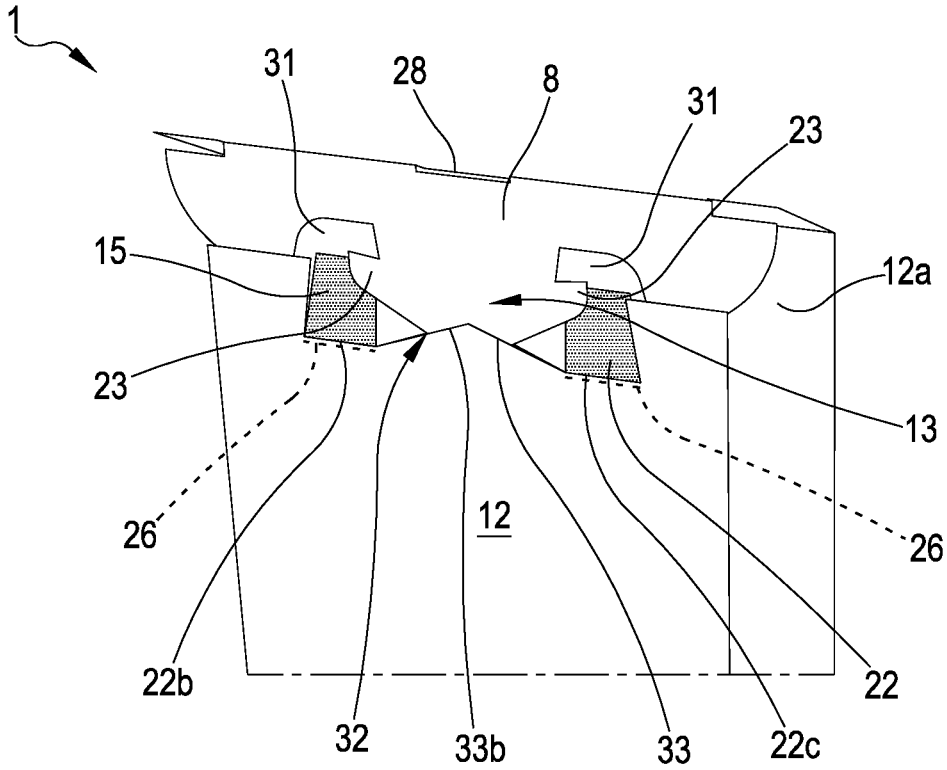
FIG. 5B shows a coupling system under an initial closing step.

The hook 22 of the second coupling portion 14 exhibits at least one attachment edge engaged with the perimetral edge 12*a* of the second base portion 12. In detail, the hook 22 exhibits a first and a second attachment edge 22*b*, 22*c* opposite to each other and optionally symmetric with respect to a mid-axis of the second coupling portion 14 (FIGS. 1, 5A, 5B). In the latter embodiment, the gripping edge 22*a* of the hook 22 of the second coupling portion 14 is interposed between the first and the second attachment edge 22*b*, 22*c*. The hook 22 is therefore rotatably movable around the first and the second attachment edge 22*b*, 22*c*, optionally by an angle below 45°, in particular below 30°, even more in particular below 20°. This angle of rotation of the hook 22 around the perimetral edge 12*a* is measured with respect to a central configuration of the hook 22 in which the latter extends as a prolongation of, parallel to, the second base portion 12. The hook 22 may exhibit freedom of rotation nearing both the first and the second surface of the second base portion 12. The hook 22 is integrally joined to the second base portion 22.

The gripping edge 22*a* of the hook 22 of the second coupling portion 14 defines, cooperatively with the perimetral edge 12*a* of the second base portion 12, a passage 32 adapted to receive, when crossed, the first coupling portion 13 for the engagement of the latter with the hook 22 of the second coupling portion 14. In particular, the passage 32 is defined by part of the perimetral edge 12*a* and by the gripping edge 22*a* of the hook 22, optionally in which the gripping edge 22*a* of the hook 22 is counter-shaped to the portion of perimetral edge 12*a* of the second base portion 12. The hooks 22, 23, of the first and second coupling portions 13, 14, are configured for stably engaging with each other under the arming condition of the coupling system 1: the hooks 22, 23—under the arming condition—exhibit respective concavities facing each other. In greater detail, the gripping edge 22*a* of the hook 22 and the respective gripping edges 23*a* of the respective hook 23 are configured for stably engaging with each other under the arming condition of the coupling system 1. The step of coupling the hooks 22, 23 occurs by means of an initial condition of contact between the first and the second coupling portions 13, 14; in particular, the first coupling portion 13 is inserted interposed between the hook 22 of the second coupling portion 14 and the second base portion 12, inside the passage 32: in such condition the first coupling portion 13 is slid on the hook 22 of the second coupling portion 14. After, the first coupling portion 13 is pressed below the second coupling portion 14 so that the respective hook 23 (optionally the respective hooks 23) couples with the hook 22 defining the arming condition. Under the arming condition, the first and the second coupling portions 13, 14 are substantially aligned along a coupling direction (see, for example, FIGS. 5 and 6): at least the first base portion 11 bearing the first coupling portion 13 is directly interposed between the second base portion 12 and the hook 22.

As shown in the accompanying Figures, the second base portion 12 may include a through cavity 29 delimited by a cut edge 33. The cut edge 33 is defined by part of the perimetral edge 12*a* of the second base portion 12. The cut edge 33 delimits a depression of the second base portion 12, in which the second coupling portion 14 is at least partially arranged inside said depression. In detail, the hook 22 of the second coupling portion 14 is at least partially arranged inside said depression. Even more in detail, the hook 22 of the second coupling portion 14 is at least partially counter-shaped to the depression defined by the through cavity 29 on the second base portion 12. The hook 22 is engaged with at least part of the depression defined by the through cavity 29: the hook 22 is engaged with at least part of the cut edge 33 of the through cavity 29 by means of the attachment edge 22*b*. More in detail, the hook 22 is engaged with at least part of the cut edge 33 of the through cavity 29 by means of the two attachment edges 22*b*, 22*c* of the hook 22. In other words, the cut edge 33 defined by the cavity 29 includes the first and the second attachment edge 22*b*, 22*c* of the hook 22 of the second coupling portion 14. The cut edge 33 of the through cavity 29 defines, cooperatively with the gripping edge 22*a* of the hook 22 of the second coupling portion 14, the passage 32 adapted to receive in insertion the first coupling portion 13.

The through cavity 29 of the second base portion 12 faces the displaying opening 31 of the first coupling portion 13, at least under a arming condition of the coupling system 1. In detail, the displaying opening 31 of the first coupling portion 13 and the through cavity 29 of the second base portion 12 are facing each other so as to enable, with respect to a front view of the second base portion 12 and under the first arming condition of the coupling system 1, the display of at least part of the removable portion 15.

Figure 9:
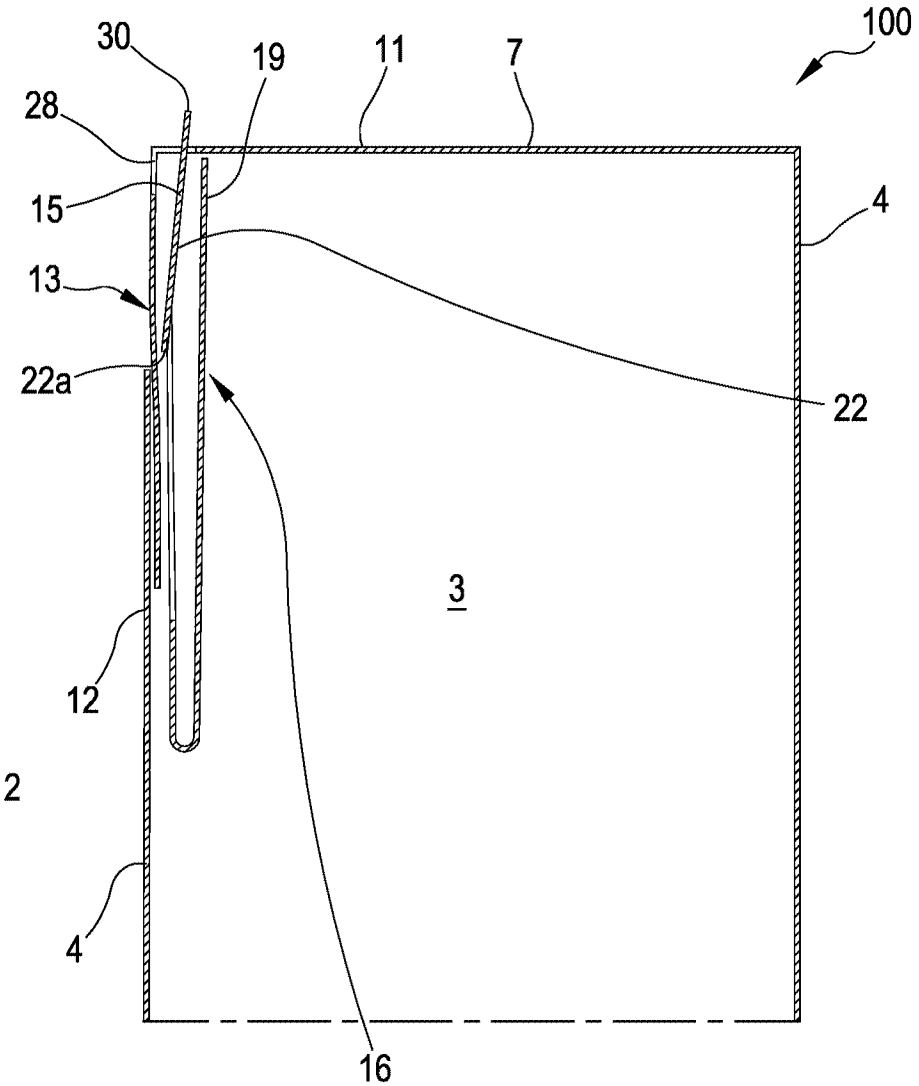
FIG. 9 is a sectional view, taken along the line IX-IX, of the container of FIG. 6B.
Figure 11:
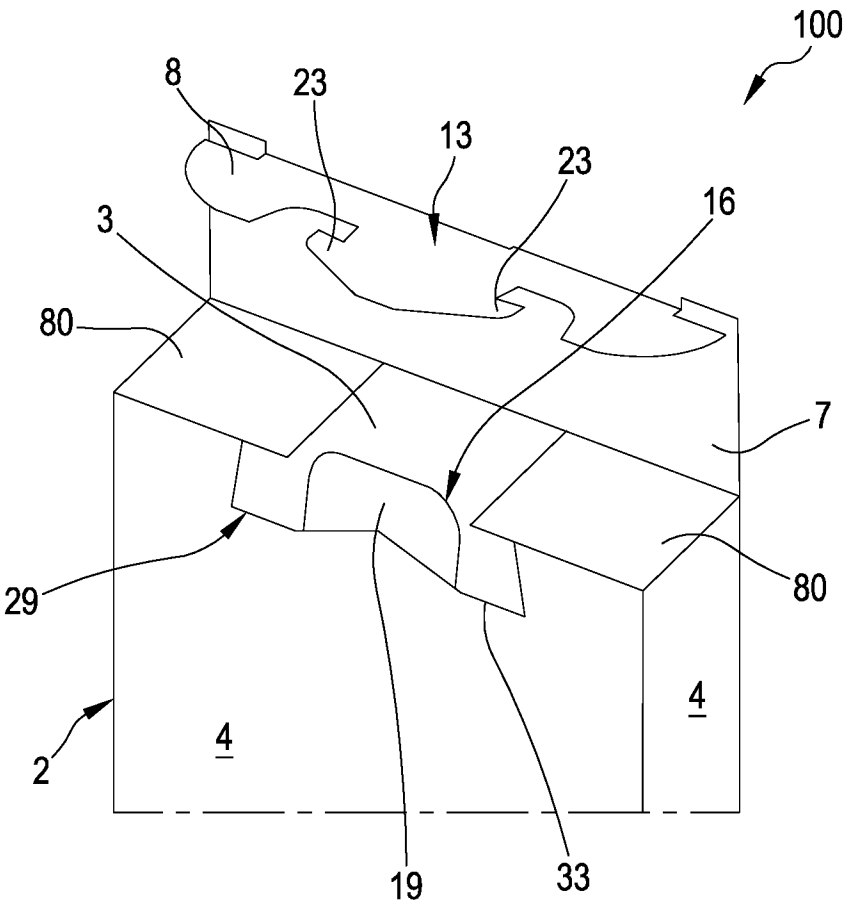
FIGS. 10 and 11 are respective perspective views of a container including the coupling system following a first open or tampering condition.
Figure 10:
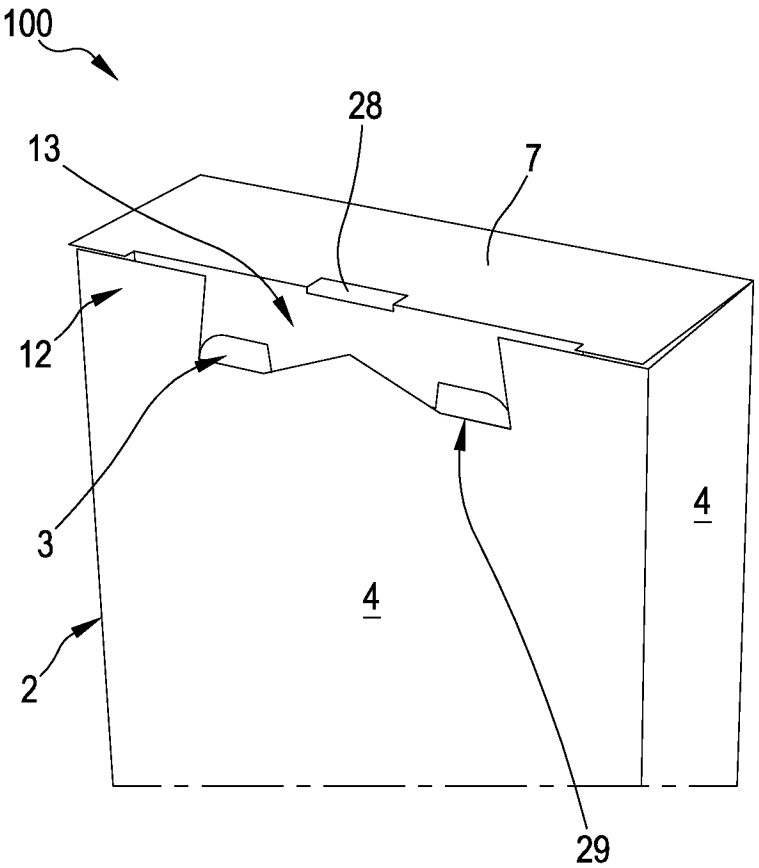
Figure 16:
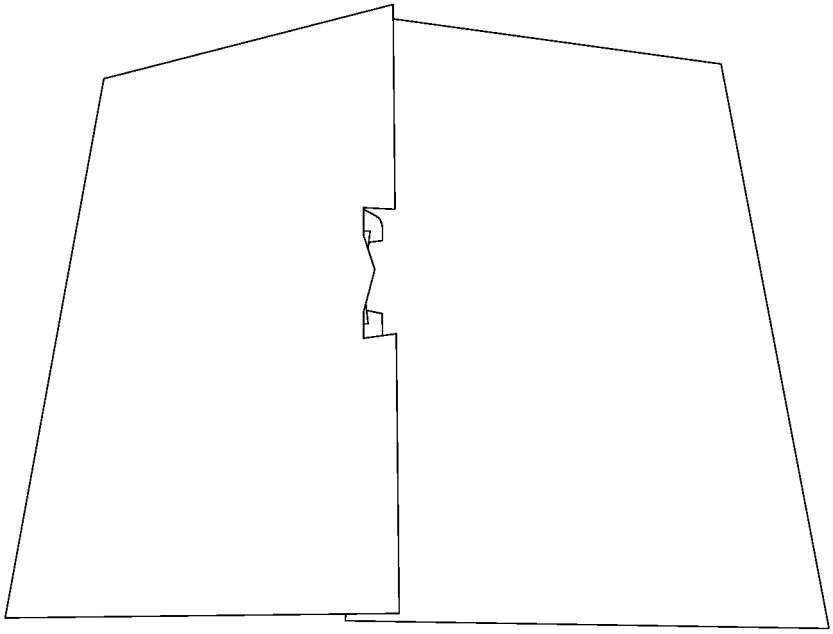
Figure 17:
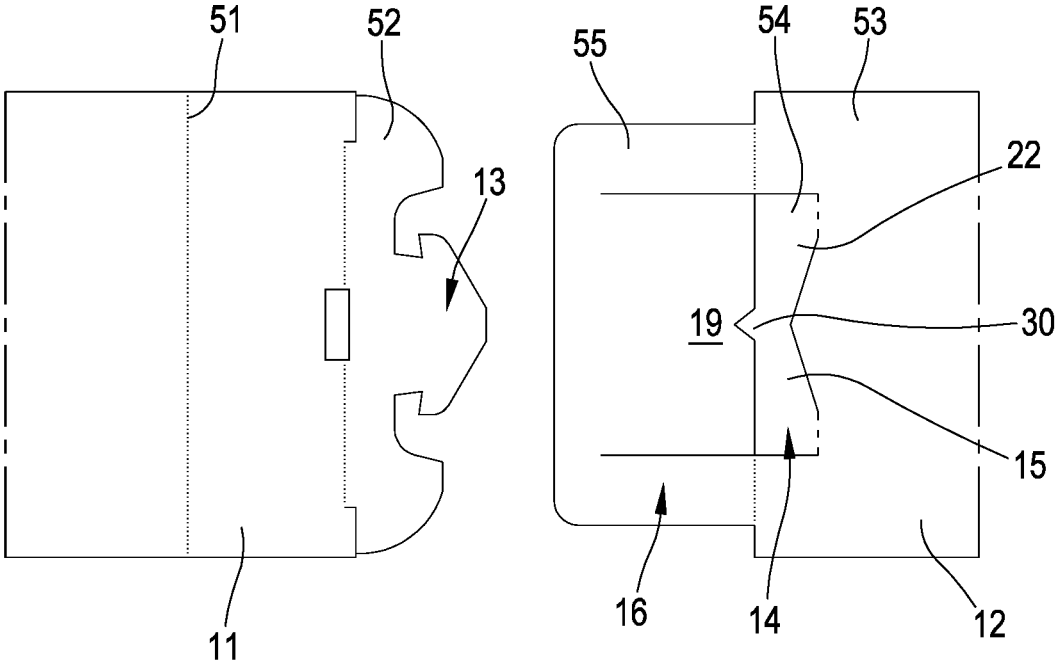
FIGS. 17-18 show a coupling system in accordance with the present invention in a second embodiment.
Figure 18:
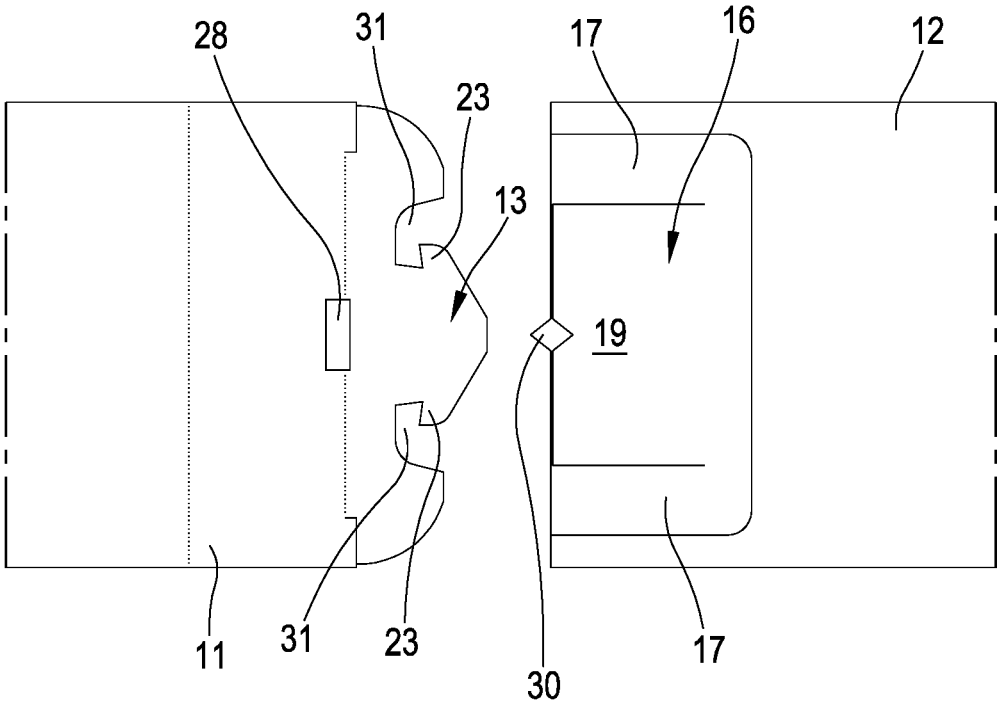

The coupling system 1 includes at least one removable portion 15 of sheet material borne by at least one between the first and the second coupling portions 13, 14; the removable portion 15 is configured for separating from the coupling system 1 upon a first disengagement condition between the first and second coupling portions 13, 14 following the arming condition. The first disengagement condition is shown in FIGS. 10-11 and 16 while the arming condition of the coupling system 1 is shown in FIGS. 8-9, 23-24. The separation of the removable portion 15 determines the impossibility of a following engagement between the first and second coupling portions 13, 14, so as to show a tampering of the coupling system 1. In other words, a possible attempt to open or tamper with the coupling system 1, following the arming condition of said system 1, would determine the breaking and therefore the detachment of the removable portion 15 from the coupling system 1 itself (FIGS. 10-11). Thereby, by virtue of the removable portion 15, it is possible to highlight the tampering of the coupling system 1 and inhibit a following anchoring between the first and the second coupling portions 13, 14.

In an embodiment shown in FIGS. 1-3, 5-9, 13-15, 17-24, the removable portion 15 is defined by the second coupling portion 14. In greater detail, the removable portion 15 is defined by the hook 22 of the second coupling portion 14 and by the respective gripping edge 22*a*. In said configuration, the second coupling portion 14 includes a weakening element 26, shown, for example, in FIGS. 1-6, 17-18, delimiting the hook 22 and defining the removable portion 15. In greater detail, the weakening element 26 is placed between the hook 22 and the second base portion 12, in particular at an attachment edge 22*b* of the hook 22. In the embodiment shown in the accompanying Figures, the removable portion 15 defined by the hook 22 exhibits two weakening elements 26 at the two attachment edges 22*b*, 22*c*. The weakening element 26 of the removable portion 15 enables the separation of the removable portion 15 from the second base portion 12 following a first opening attempt of the coupling system 1 upon the arming condition, so as to highlight the tampering thereof and impede a following arming condition. Being the removable portion 15 defined by the hook 22 of the second coupling portion 14, also the removable portion 15 is rotatably movable around the weakening element 26. In the embodiment in which the removable portion 15 is defined by the hook 22, the displaying opening 31 of the first coupling portion 13 enables the display of at least part of the removable portion 15, at least under the arming condition of the coupling system 1. Furthermore, the displaying opening 31 enables the proper insertion of the first coupling portion 13 inside the passage 32 defined by the gripping edge 22*a* of the hook 22 and by part of the cut edge 33 of the through cavity 29 exhibited on the second base portion 12. Optionally, the displaying opening 31 enables the display of the weakening element 26 constraining the removable portion 15 to the cut edge 33 of the through cavity 29. As shown in the accompanying Figures, the removable portion 15 is at least partially contained inside the through cavity 29 and is counter-shaped by the cut edge 33 of the through cavity 29.

The removable portion 15 defined by the hook 22 of the second coupling portion 14 may exhibit a projection 30, shown in FIGS. 1-9, 17-18, 23-24, configured for allowing the user a tactile perception of the removable portion 15 itself. The projection 30 is made of sheet material and exhibits a substantially triangular shape, optionally it exhibits a trapezoidal, rectangular or semi-circular shape. For example, the removable portion 15 exhibits a single projection 30 of a triangular shape. The projection 30 of the removable portion 15 enables visually-impaired users to verify the presence of the removable portion 15 by means of a tactile perception thereof and therefore to verify the integrity or the tampering of the coupling system 1. In particular, under the arming condition of the coupling system 1, the through opening 28 allows the passage of the projection 30 of the removable portion 15 as shown in FIGS. 8-9, 23-24, through the first base portion 11, so as to allow the tactile perception thereof by the user.

In a further embodiment not shown in the accompanying Figures, the removable portion 15 is defined by at least one part of the first coupling portion 13, optionally the removable portion 15 is defined by the respective hook 23 of the first coupling portion 13. In greater detail, the first coupling portion 13 includes a weakening element 26 defining the removable portion 15.

The weakening element 26 of the first or second coupling portion 13, 14 may by defined by one or more cuts passing through the sheet material, an incision of the sheet material, a local squashing of the sheet material. The weakening element 26 enables the separation of the removable portion 15 from the coupling system 1, allowing to show the tampering following a first arming condition of the coupling system 1 itself.

Figure 24:
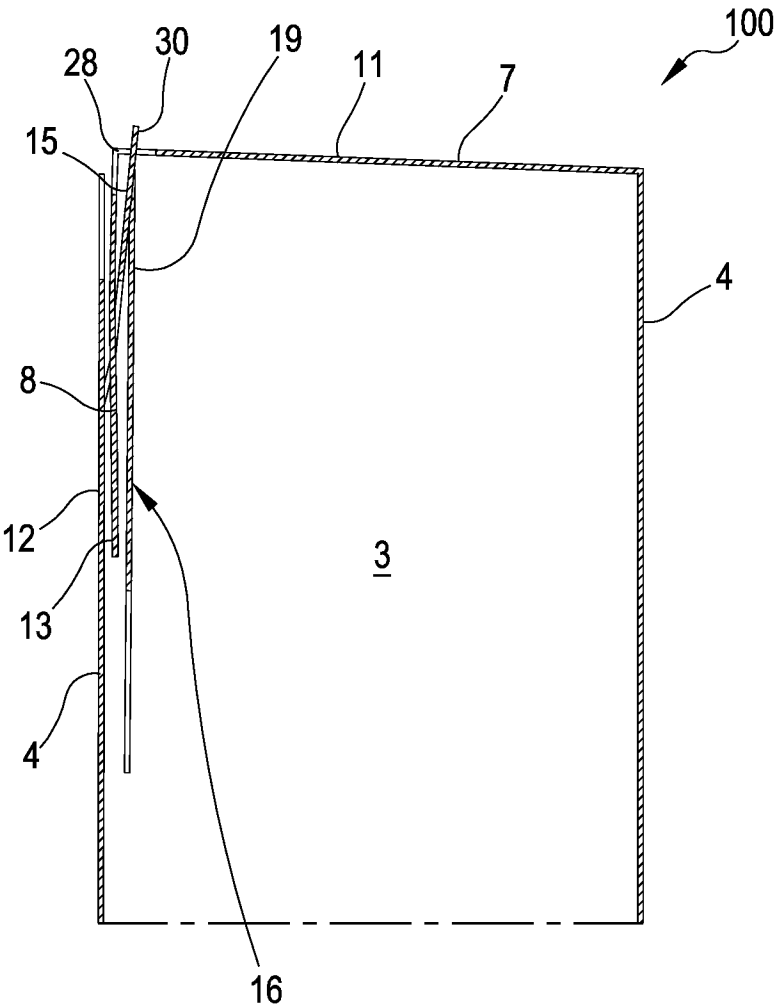
FIG. 24 is a sectional view, taken along the line XXIV-XXIV, of the container of FIG. 23.
Figure 23:
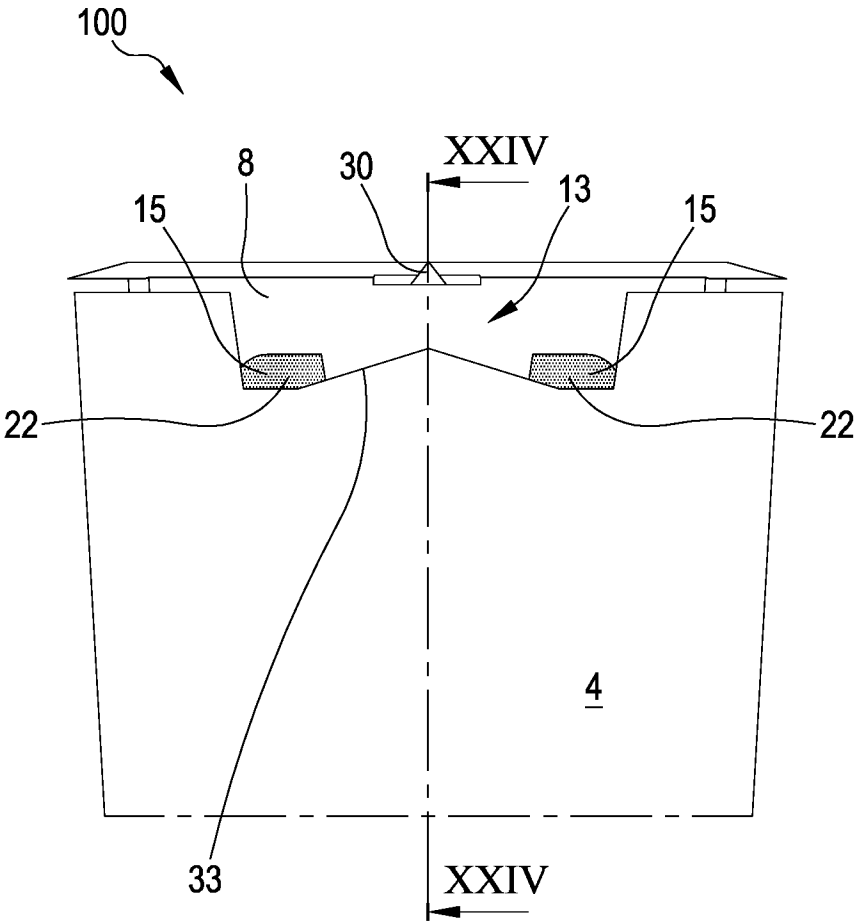
FIG. 23 shows a container in accordance with the present invention arranged under a closed condition.

The coupling system 1 further includes at least one supporting portion 16 (see FIG. 1-14, 17-24) of sheet material and constrained to at least one between the second base portion 12 and the second coupling portion 14. The supporting portion 16 is configured, at least during an initial step of putting in contact the first and the second coupling portions 13, 14 of the coupling system 1 before the arming condition, for sustaining at least part of the second coupling portion 14, in particular for sustaining the hook 22 of the second coupling portion 14. The supporting portion 16 faces the base portion 12 and/or the second coupling portion 14, in particular it faces the hook 22 as shown in FIGS. 9 and 24. The supporting portion 16 at least partially faces the removable portion 15, at least during a arming condition of the coupling system 1. The supporting portion 16 is directly constrained, in particular, it is integrally joined, to the second base portion 12. In detail, the supporting portion 16 includes a mutual coupling portion 17 overlapping and stably constrained to at least one respective mutual coupling portion 18 of at least one between the second base portion 12 and the second coupling portion 14. The mutual coupling portion 17, constrained to the respective mutual coupling portion 18, enables the supporting portion 16 to keep a substantially fixed position, reducing the possibility of a rotation of the supporting portion 16 when distancing with respect to the second coupling portion 14 or to the second base portion 12; such constraint increases a flexural stiffness of the supporting portion 16 and reduces the flexion of the supporting portion 16, considering the same load applied, when distancing with respect to the second base portion 12 or the second coupling portion 14. The mutual coupling portion 17 of the supporting portion 16 is fastened by means of adhesive material to at least one between the second base portion 12 and the second coupling portion 14. In greater detail, the mutual coupling portion 17 defines a surface of the supporting portion 16 stuck to at least one between the second base portion 12 and the second coupling portion 14. The mutual coupling portion 17 of the supporting portion 16 is defined at a bottom area 20 of the supporting portion 16. The supporting portion 16 includes two mutual coupling portions 17 symmetrical with respect to a longitudinal development trajectory of the supporting portion 16: the two mutual coupling portions 17 are constrained to two respective mutual coupling portions 18 of the second base portion 12 (see FIG. 4).

The supporting portion 16 includes a pressing portion 19 (see FIGS. 4, 5, 7, 9, 11, 22, 24) emerging from the bottom area 20 of the supporting portion 16 and configured for receiving against it the second coupling portion 14. The pressing portion 19 emerges from the bottom portion 20 of the supporting portion 16 along a longitudinal development trajectory of the supporting portion 16 itself and exhibits a rectangular, optionally trapezoidal or triangular or semicircular shape. In an embodiment, said longitudinal development trajectory is placed in the mid-axis of the supporting portion 16, so that the longitudinal development trajectory defines a symmetry axis of the supporting portion 16. The pressing portion 19 is configured for sustaining the hook 22 of the second coupling portion 14 during an initial step of putting in contact the first and the second coupling portions 13, 14 of the coupling system 1 before the arming condition, as shown in FIGS. 21-22 and 6B-7.

The pressing portion 19, the base area 20 and the mutual coupling portion 17 of the supporting portion 16 may be integrally joined defining a tab of sheet material.

The supporting portion 16 is substantially parallel to the second coupling portion 14 and to the second base portion 12. FIG. 9 shows a section of the coupling system 1 under a first arming condition, in which the substantial parallelism between the second base portion 12 and the supporting portion 16 is shown. In said embodiment, the supporting portion 16 is obtained by means of the multiple folding of a single sheet. In a further embodiment, shown in FIGS. 17-18, the supporting portion 16 is obtained by means of a single folding of a single sheet of paper material. FIG. 24 shows a section of the coupling system 1 shown in FIG. 23 under a first arming condition in accordance with said further embodiment, highlighting the substantial parallelism between the second base portion 12 and the supporting portion 16.

The supporting portion 16 may include a weakening portion 24 (FIGS. 1-5) configured for allowing the supporting portion 16 to define a holding operating condition and a releasing operating condition. The weakening portion 24 may be defined by means of one or more cuts, incisions or veining of the sheet material defining the supporting portion 16. In an embodiment shown in FIGS. 1-5 and 12-14, the supporting portion 16 exhibits two weakening portions 24, in particular, symmetrical to each other with respect to a mid-axis of the coupling system 1.

Figure 6A:
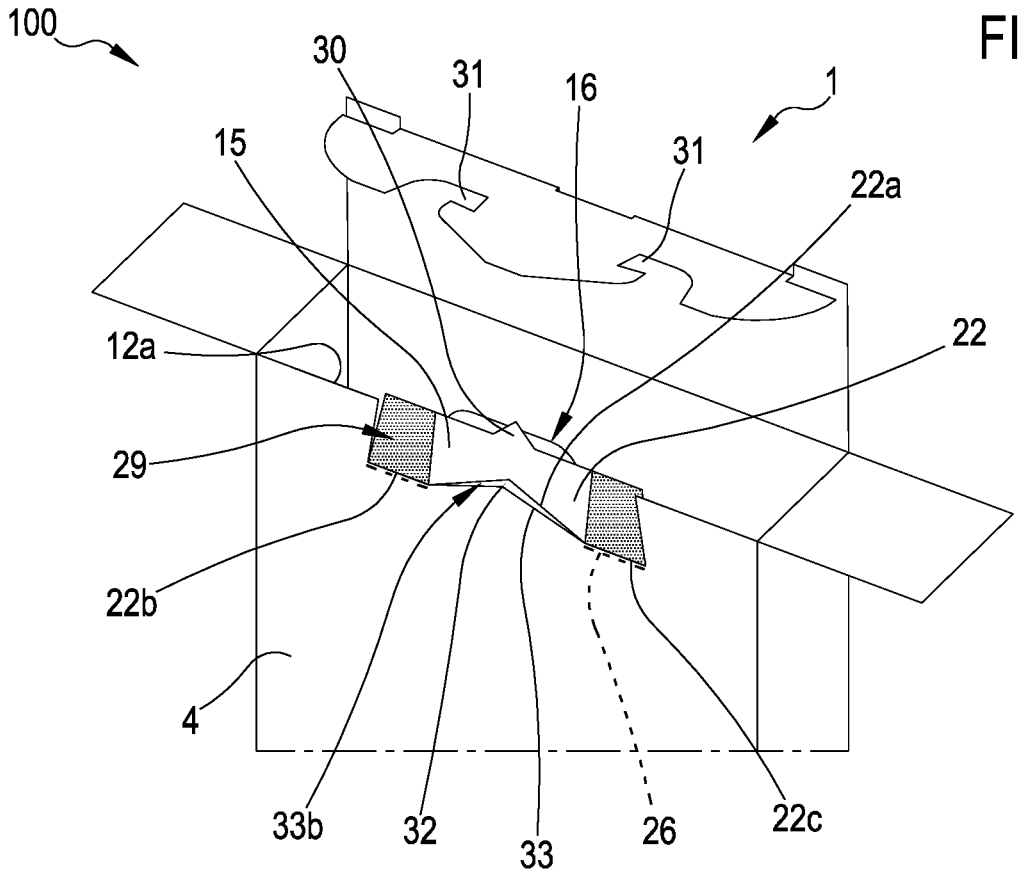
FIG. 6A shows a container, including a coupling system, arranged under an open condition.
Figure 6B:
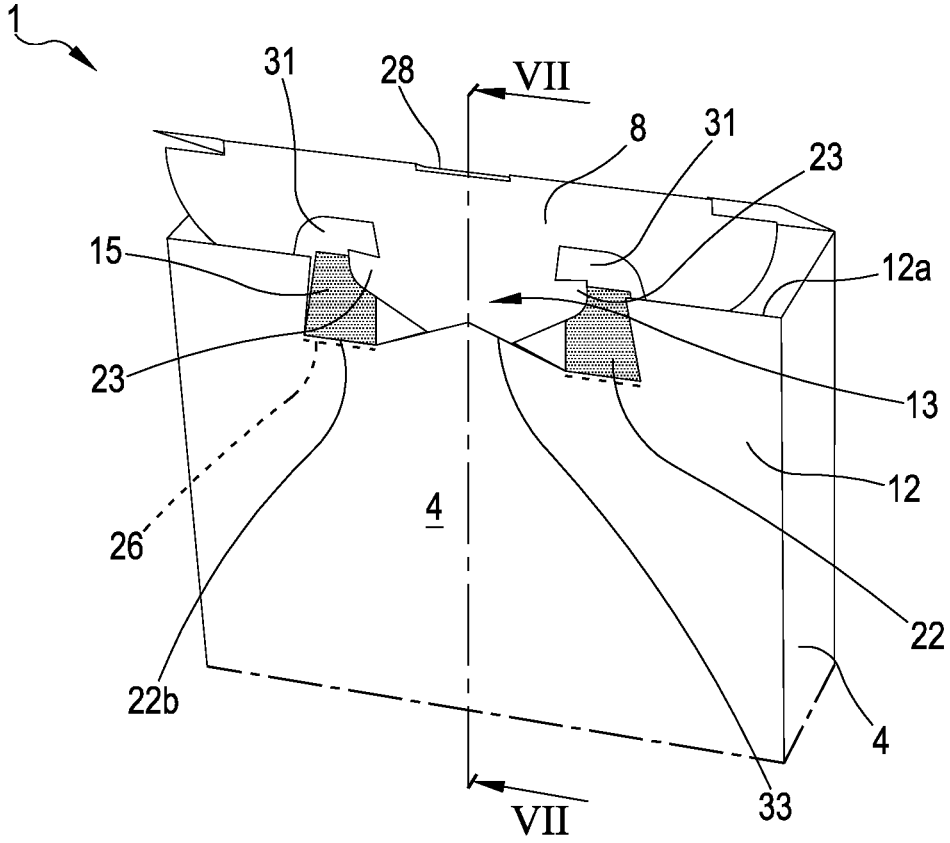
FIG. 6B shows a container, including a coupling system, during an initial closing step of the container itself.
Figure 7:
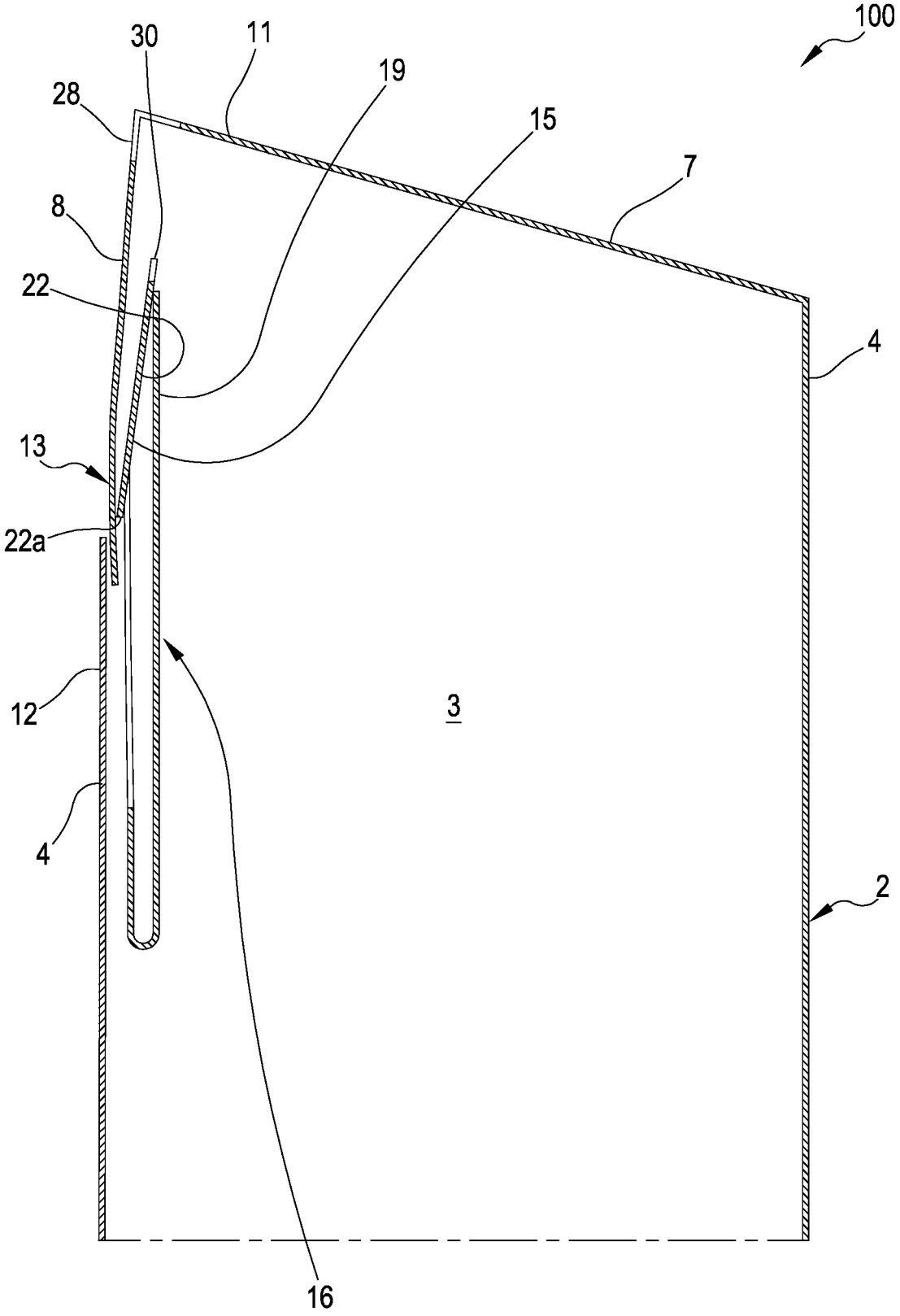
FIG. 7 is a sectional view, taken along the line VII-VII, of the container of FIG. 6B.

The holding operating condition, shown in FIG. 6B and in the corresponding section of FIG. 7, is defined during an initial step of the arming condition under which the first coupling portion 13 rests against the second coupling portion 14: in such condition, the weakening portion 24 is intact and enables the supporting portion 16 itself to sustain the second coupling portion 14 limiting the movement thereof. Under the holding condition, the pressing portion 19 of the supporting portion 16 enables to sustain the hook 22 of the second coupling portion 14, as well shown in the section of FIG. 7. In greater detail, the pressing portion 19 of the supporting portion 16, under the holding operating condition, exerts a pressure on the hook 22 of the second coupling portion 14 to increase a flexural stiffness thereof. The supporting portion 16, in particular the pressing portion 19, is therefore configured, under the holding operating condition, for limiting the angular displacement of the hook 22 of the second coupling portion 14 to values below 90°, in particular from 0° to 70°, even more in particular from 0° to 45°. Said angular values are measured as the rotation of the hook 22 around the attachment edge 22*b* and with respect to the second base portion 12. The angular displacement is understood as the relative rotation of the hook 22 considered between an initial position of the hook 22 shown in FIG. 5A, before the holding operating condition, essentially aligned with and parallel to the second base portion 12, and a final position which the hook 22 may assume under the holding operating condition.

The support provided by the supporting portion 16, in particular, by the pressing portion 19, allows to obtain greater security and efficacy during the initial arming step of the coupling system, in particular, during the nearing and putting in contact of the first coupling portion 13 and the second coupling portion 14. In other words, being the arming step automatic, the pressing portion 19 prevents a possible overturning of the hook 22 of the second coupling portion 14 due to the pressing force exerted by the respective hook 23 of the first coupling portion 13 on the hook 22 of the second coupling portion 14 during the initial anchoring step of the coupling system 1. The presence of the supporting portion 16 constrained to the base portion 12 is, therefore, an improvement to the first anchoring step of the coupling system 1.

Figure 8:
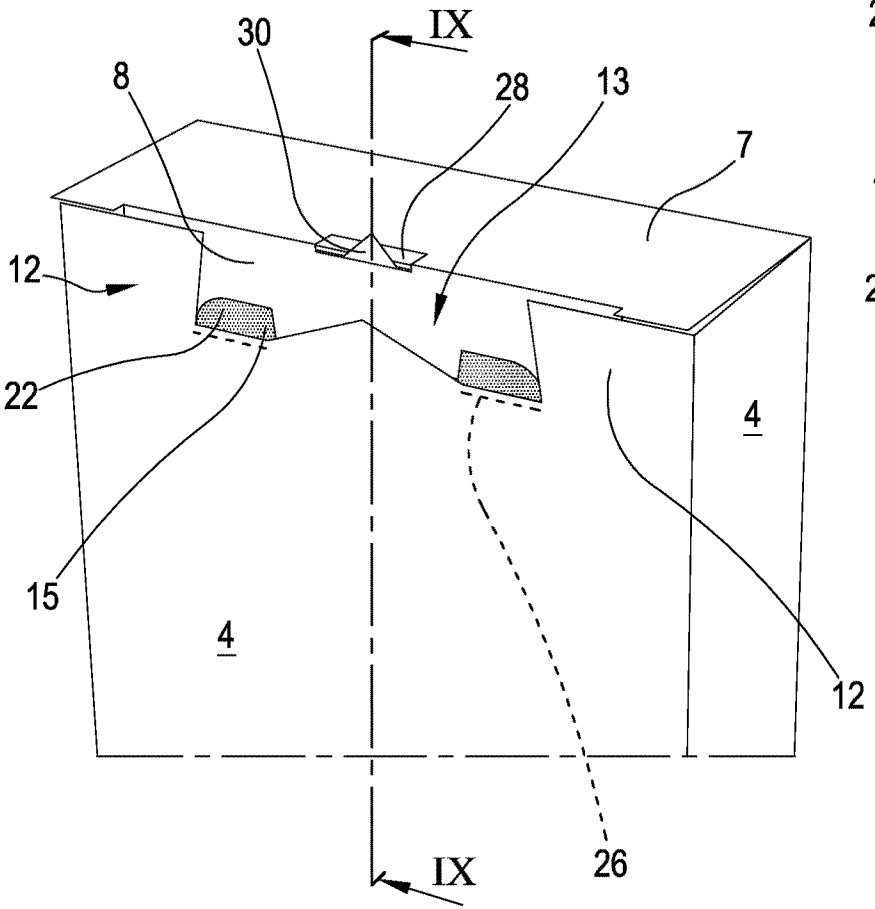
FIG. 8 shows a container, including a coupling system, under a fully closed condition of the container itself.

The releasing operating condition, shown in FIG. 8 and in the corresponding section of FIG. 9, is defined at least under the arming condition in which the total or partial breaking of the weakening portion 24 occurs, so that the supporting portion 16 may enable a greater movement of the hook 22 of the second coupling portion 14 with respect to the holding operating condition. In particular, the weakening portion 24 is configured for allowing the passage of the supporting portion 16 from the holding operating condition to the releasing one during the definition of the arming condition of the coupling system 1. The releasing operating condition defines a decrease of the flexural stiffness of the supporting portion 16. The supporting portion 16, under the releasing operating condition, is configured for enabling an angular displacement of the hook 22 of the second coupling portion 14 greater than the angular displacement enabled under the holding operating condition. The greater freedom of movement of the hook 22 of the second coupling portion 14 under the releasing operating condition, with respect to the holding operating condition, increases the security of the coupling system 1, since it makes the tampering thereof more difficult. The releasing operating condition follows the holding operating step. The supporting portion 16, in addition to acting as a support element for the second coupling portion 14, may perform the signaling function to further show a possible tampering of the coupling system 1. The supporting portion 16 is adjacent to, in particular, it faces, the hook 22 of the second coupling portion or the removable portion 15, at least under the arming condition of the coupling system 1; it is therefore possible to arrange a marker on the supporting portion 16 (for example, a change of color with respect to the removable portion 15) so that, in the absence of the portion 15, the supporting portion 16 may highlight, by means of the marker, the absence of said removable portion 15. The supporting portion 16 may act as a marker both in case the removable portion 15 is defined on the second coupling portion 14 (the supporting portion would be visible at least from the cavity 29 and/or from the through opening 28) and in case it is defined on the first coupling portion 13 (the supporting portion would be visible at least from the cavity 29 of the second base portion).

Container 100

The coupling system 1 previously described in each embodiment thereof may be coupled to a container 100 as shown in FIGS. 6A-B,7-11, 21-24. The container 100 includes at least one storage 2 defining an internal volume 3 configured for housing products, for example pills, tablets or blister packs (the products are not shown); the storage 2 is essentially the compartment adapted to house and support the products. In greater detail, the storage 2 includes a predetermined number of lateral walls 4 defining at least one passage opening 5 delimited by a free edge 6: the passage opening 5 is configured for putting in communication the internal volume 3 of the storage 2 with the external environment. In the accompanying Figures a storage 2 is shown, exhibiting two opposite passage openings 5, so that the storage substantially defines a duct laterally delimited by the wall 4 and open at the longitudinal ends. The possibility of manufacturing, for example, a storage 2 exhibiting a single passage opening 5 or even a number of openings 5 greater than two (conditions not shown in the accompanying Figures) is not excluded. The storage 2 may exhibit a prismatic rectangular shape (plane lateral walls 4 having a rectangular shape). However, the possibility of manufacturing a storage 2 having a different shape, for example square, trapezoidal or cylindrical, is not excluded. The storage 2 is made of sheet material, optionally paper, and is obtained, for example, by means of folding.

The container 100 further includes the coupling system 1 previously described. The first base portion 11 is rotatably constrained to the free edge 6 of the storage 2: the first coupling portion 13 is borne by the first base portion 11 so that the latter is interposed between the free edge 6 of the storage 2 and the first coupling portion 13. The first base portion 11 and the first coupling portion 13 are movable, in particular, rotatably, with respect to the storage 2 and are configured for defining at least one closed condition in which at least part of the first base portion 11 interdicts the communication between the internal volume 3 of the storage 2 and the external environment. The first base portion 11 and the first coupling portion 13 are further configured for defining an open condition in which the latter themselves enable the communication between the internal volume 3 and the external environment. The first base portion 11 is integrally joined to the free edge 6 of the storage 2: in particular, the first base portion 11 is integrally joined to at least one lateral wall 4 of the storage 2 defining a single body of paper material.

As shown in the accompanying Figures, the first coupling portion 13 extends as a prolongation of the first base portion 11 from the opposite part to the storage 2, The first base portion 11 essentially includes a closing portion 7 of sheet material directly engaged with the free edge 6 of the storage 2 and movable, in particular rotatably, with respect to the latter. The closing portion 7 is counter-shaped to the opening 5 of the storage 2, so that, under the closed condition of the container 100, the closing portion 7 may interdict the passage from the internal volume 3 of the storage 2 to the external environment. The closing portion 7 exhibits a rectangular or square shape (FIGS. 13, 14); however, the possibility that the closing portion may exhibit geometrical shapes other than those shown in the accompanying Figures is not excluded.

The first base portion 11 further includes at least one inserting portion 8 configured for being inserted, under the closed condition of the container, inside the volume 3 of the storage 2. The inserting portion 8 substantially includes a plane body of sheet material having, for example, a rectangular shape. As shown, for example, in the sectional view of FIG. 9, the inserting portion 8 extends between a first and a second prevalent development surface, respectively facing outwards (directly facing a lateral wall 4 of the storage 2) and towards an internal volume 3 of the storage 2. Under the closed condition of the container, at least one portion of the first development surface of the inserting portion 8 directly faces, in particular, is put in contact with, a part of a lateral wall 4 of the storage 2: said surface extends at least partially parallel to the wall 4 of the storage 2, in particular, to a front wall of the storage 2 opposite the wall directly connected to the closing portion 7. The closing portion 7 and the inserting portion 8 exhibit a mutual connection edge opposite to the free edge 6 of the storage 2 with respect to the closing portion 7 itself: the inserting portion 8 is rotatably movable with respect to the closing portion 7 around said mutual connection edge. As shown, for example, in FIG. 9, the inserting portion 8, under the arming condition of the coupling system 1, is configured for defining, according to a cross section and cooperatively with the closing portion 7, substantially an L-shape: under such condition, the inserting portion 8 extends substantially parallel to a lateral wall 4 of the storage 2.

The closing portion 7 and the inserting portion 8 of the first base portion 11 are integrally joined defining a closing tab 9 of the container 100 made of sheet material, for example, paper. The closing portion 7 and the inserting portion 8 are exhibited on each of the openings 5 of the container 100. In particular, the closing tab 9 is integrally joined to the free edge 6 of the storage 2 and, therefore, to at least one lateral wall 4 of the container 100. In the accompanying Figures, a configuration of the closing tab 9 exhibiting a rectangular shape, entirely counter-shaped to free edge 6, has been schematized. The through opening 28 of the coupling system 1 is defined on the closing portion 7 and/or on the inserting portion 8, and is arranged, under a closed condition of the container 100, in particular, at the removable portion 15 under the arming condition. The through opening 28, upon the arming condition of the coupling system 1 and before the first disengagement condition, is adapted to allow the passage of the projection 30 and, therefore, the exit thereof from the storage 2 (see FIG. 13 and the respective section of FIG. 15). The second base portion 12 of the coupling system 1 defines at least part of an external lateral wall 4 of the storage 2 from which the second coupling portion 14 emerges, in particular from which the hook 22 of the second coupling portion 14 emerges.

The coupling system 1, under a first closed condition of the container 100, is configured for defining the arming condition in which the first and the second coupling portions 13, 14 are engaged with each other. In particular, under the first closed condition of the container 1 and therefore under the arming condition, the first and the second coupling portions 13, 14 are configured for engaging with each other in the internal volume 3 of the storage 2. The coupling system 1—under a first open condition of the container 100 following the first closed condition—is configured for defining the first disengagement condition under which the removable portion 15 is configured for separating from the coupling system 1 to show a tampering of the coupling system 1 itself and therefore of the container 100. In detail, the hook 22 of the second coupling portion 14, during the passage from the open condition to the first closed condition of the container, is configured for rotating with respect to a lateral wall 4 of the storage 2 according to a direction entering the internal volume 3 of the storage 2 so that the gripping edge 22*a* of the hook 22 of the second coupling portion 14 may define, cooperatively with a lateral wall 4 of the storage 2 (in particular, with the remaining part of the lateral wall 4 of the storage from which the hook 22 emerges), the passage 32 adapted to receive, when crossed, the first coupling portion 13 for the engagement of the latter with the second coupling portion 14. In detail, the hook 22 defines the removable portion 15 which is, therefore, directly constrained to an edge of the lateral wall 4 of the storage 2. The removable portion 15 is connected at the head thereof to an edge of the lateral wall 4 of the storage 2 defining a prolongation of the lateral wall 4 itself: in detail, the removable portion 15 is connected to the lateral wall 4 of the storage 2 by means of the weakening element 26.

The displaying opening 31 of the first base portion 13 is configured for enabling the display—from the outside of the storage 2—of at least part of the removable portion 15 defined by the hook 22 of the second coupling portion 14, at least in the first closed condition of the container. Optionally, the displaying opening 31 of the first base portion 13 is configured for enabling the display—from the outside of the storage 2—of the internal volume 3 of the storage 2 upon an opening of the coupling system 1 following the first arming condition. In the latter condition, the displaying opening 31 enables the user to verify the absence of the removable portion 15 and the breaking of the weakening element 26 adapted to connect the removable portion 15 to the storage 2. The through cavity 29 of the coupling system 1 is define on at least one lateral wall 4 of the storage 2, defining the cut edge 33. In particular, the through cavity 29 is placed at an end portion of the lateral wall 4, defining a depression on the lateral wall 4 itself. Said depression placed on at least one of the lateral walls 4 of the storage 2 receives the second coupling portion 14, in particular, the hook 22 of the second coupling portion 14. Under an open condition of the container 100, in particular, under a condition preceding the first arming condition of the coupling system 1, the hook 22 of the second coupling portion 14 is placed on the same plane containing the lateral wall 4 bearing the hook 22 itself. The cut edge 33 of the through cavity 29 is defined on at least part of the lateral wall 4 bearing the hook 22 of the second coupling portion 14. The gripping edge 22*a* of the hook 22, in combination with the cut edge 33 defined on the respective lateral wall 4, defines the passage 32 adapted to receive in insertion the first coupling portion 13 (see FIG. 5A).

The supporting portion 16 of the coupling system 1 is arranged, in particular internally, in the storage 2 (see sections of FIGS. 7, 9, 22 and 24). In detail, the supporting portion 16 of the coupling system 1 is entirely arranged in the internal volume 3 of the storage 2. Optionally, the supporting portion 16 is substantially parallel to at least one lateral wall 4, in particular, to the lateral wall 4 defined by the second base portion 12. The mutual coupling portion 17 of the supporting portion 16 is engaged with an internal surface of at least one lateral wall 4 of the storage 2 spaced from the free edge 6. The pressing portion 19 of the same supporting portion 16 extends from said mutual coupling portion 17 nearing the free edge 6, in particular, the pressing portion 19 extends up to the free edge 6.

Figure 13:
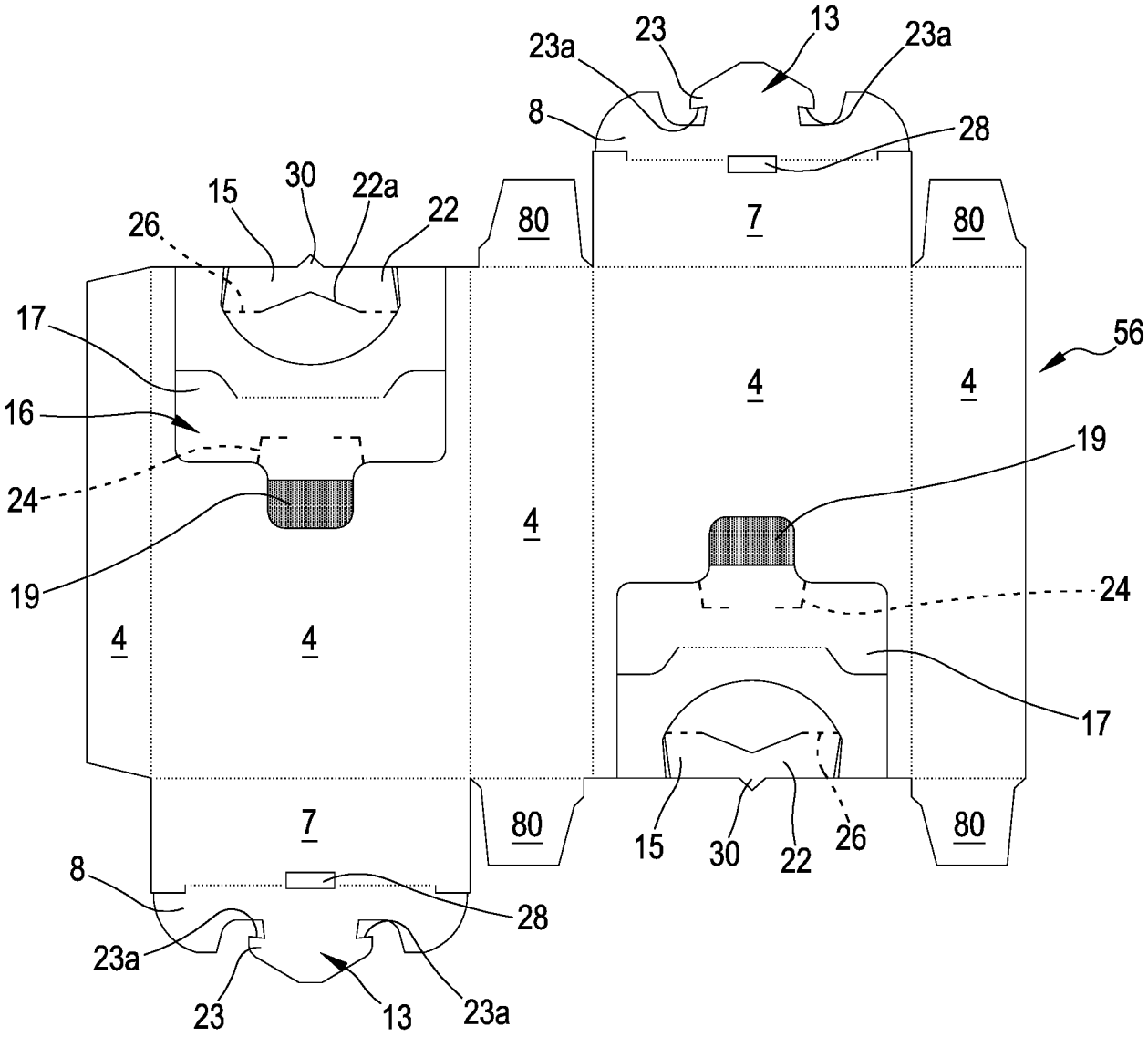
FIG. 13 diagrammatically shows a first folding step of the draft of FIG. 12 for the definition of the coupling system associated with the container.

As shown, for example, in FIGS. 6B, 11, 13, the container 100 may further include at least one abutment portion 80 engaged with the free edge 6 of the storage 2 adjacent to the closing portion 7: the abutment portion 80, in the closed condition, is configured for being interposed between the internal volume 3 and the closing tab 9 so as to cooperate with the latter to stably keep it in said closed condition. The abutment portion 80 essentially includes a plane tab of sheet material integrally joined to the free edge 6 of the storage 2 adjacent to the closing portion 7. The abutment portion 80 may exhibit a rectangular or trapezoidal shape. Also the abutment portion 80 is configured for rotating around the free edge 6 to face, at least in the closed condition of the container 1, towards the inside of the storage 2. In greater detail, the abutment portion 80 is constrained to the free edge 6 so as to engage, in the closed condition of the container 100, at least part of the inserting portion 8 and/or of the closing portion 7 to stably keep the closing tab 9 in said condition. The container 1 includes two abutment portions 80 opposite to each other with respect to the closing tab 9: the latter is interposed between the two abutment portions 11. In such configuration, the two abutment portions 80 symmetrically work on the closing tab 9 to keep it stably under the closed condition.

Process of Manufacturing the Coupling System 1

Furthermore, it is an object of the present invention a process for the manufacturing of the tamper-evident coupling system 1, in accordance with one or more of the accompanying claims and/or in accordance with the above detailed description. The process includes the following steps:

- preparing at least one first base portion 11,
- preparing at least one first coupling portion 13,
- preparing at least one second base portion 12,
- preparing at least one second coupling portion 14,
- preparing at least one supporting portion 16,
- preparing at least one removable portion 15,
- constraining at least one part of the supporting portion 16 to at least one between the second base portion 12 and the second coupling portion 14.

In detail, the step of preparing the second coupling portion 14 provides for constraining said portion to a perimetral edge 12*a* of the second base portion 12 so that the second coupling portion 14 may be placed, at the head thereof, at the second base portion 12 and may extend as a prolongation of the latter. The gripping edge 22*a* of the hook 22 of the second coupling portion 14 faces the perimetral edge 12*a* of the second base portion 12, in which the gripping edge 22*a* of the hook 22 of the second coupling portion 14 defines, cooperatively with the perimetral edge 12*a* of the second base portion 12, a passage 32 adapted to receive, when crossed, the first coupling portion 13 for the engagement of the latter with the second coupling portion 14. In particular, the step of preparing the first base portion 11 includes a step of preparing a first sheet 51 on a plane surface and at least one step of cutting the first sheet 51 defining the first base portion 11. The step of preparing the first coupling portion 13 includes a step of preparing a second sheet 52 on a plane surface and a step of cutting the second sheet 52 defining the first coupling portion 13. In particular, this cutting step defines the respective hook 23 of the first coupling portion 13. Even more in detail, the cutting step defines the gripping edge 23*a* delimiting an undercut portion of the first coupling portion 13. The first and the second sheet 51, 52 are integrally joined to form a single body. The step of preparing the second base portion 12 includes a step of preparing a third sheet 53 on a plane surface and a step of cutting the third sheet 53 defining the second base portion 12. The step of cutting the third sheet 53 is adapted to further define the through cavity 29 on the second base portion 12. The step of preparing the second coupling portion 14 includes a step of preparing a fourth sheet 54 on a plane surface and a step of cutting the fourth sheet 54 defining the second coupling portion 14. In particular, said cutting step defines the hook 22 of the second coupling portion 14. Even more in detail, the cutting step defines the gripping edge 22*a* delimiting an undercut portion of the second coupling portion 14.

The step of preparing the second base portion 12 and the second coupling portion 14 occurs simultaneously, by means of a step of preparing a single sheet according to a plane configuration, cutting said single sheet to delimit the second base portion 12 and part of the second coupling portion 14, said cutting step being adapted to delimit at least part of the hook 22 of the second coupling portion 14 integrally joined to the second base portion 12. Furthermore, the step of preparing the second base portion 12 and the second coupling portion 14 occurs simultaneously, by means of a step of realizing the weakening element 26 between the hook 22 of the second coupling portion 14 and the second base portion 12 so that said hook 22 may define the weakening portion 15.

The step of preparing the supporting portion 16 includes a step of preparing a fifth sheet 55 on a plane surface and a step of cutting the fifth sheet 55 defining the supporting portion 16. In particular, the cutting step defines the mutual coupling portion 17 and the pressing portion 19. The third, the fourth and the fifth sheet 53, 54, 55 are integrally joined to form a single body. The step of cutting the fifth sheet 55 defines the weakening portion 24 configured for allowing the supporting portion 16 the passage from the holding condition to the releasing one during the definition of the arming condition of the coupling system 1. The step of preparing the removable portion 15 includes a step of cutting the second 52 or fourth sheet 54 defining the weakening element 26 of the removable portion 15; such cutting step provides for at least one operation between punching, engraving, shearing and/or laser cutting the first or the second coupling portion 13, 14.

The step of constraining at least one part of the supporting portion 16 to at least one between the second base portion 12 and the second coupling portion 14 may provide for a step of sticking the supporting portion 16 to at least one between the second base portion 12 and the second coupling portion 14. In particular, the step of constraining provides for the sticking of the mutual coupling portion 17 of the supporting portion 16 to the respective mutual coupling portion 18 of at least a selected one of the second base portion 12 and the second coupling portion 14. The sticking step provides for a step of dispensing adhesive material on at least one between the first, fourth and fifth sheet 51, 54, 55. The sticking step provides for a step of dispensing adhesive material on at least one between the first and fifth sheet 51, 55. Optionally, the step of constraining at least one part of the supporting portion 16 to at least one between the second base portion 12 and the second coupling portion 14 includes a step of anchoring the supporting portion 16 to at least one between the second base portion 12 and the second coupling portion 14, by means of at least one operation selected between deformation, cutting and pressing of at least one between the first, fourth and fifth sheet 51, 54, 55. The first, second, third, fourth and fifth sheet may be of paper sheet material.

Process of Manufacturing the Container 100

Furthermore, it is an object of the present invention a process for the manufacturing of a tamper-evident container 100, in accordance with one or more of the accompanying claims and/or in accordance with the above detailed description. The process for the manufacturing of the container 100 includes the preparation of a draft as shown, for example, in FIGS. 12, 13 and 19.

In detail, the process includes at least the following steps:

preparing the storage 2, preparing the coupling system 1, whose manufacturing process occurs by means of the implementation of the steps described above.

Figure 12:
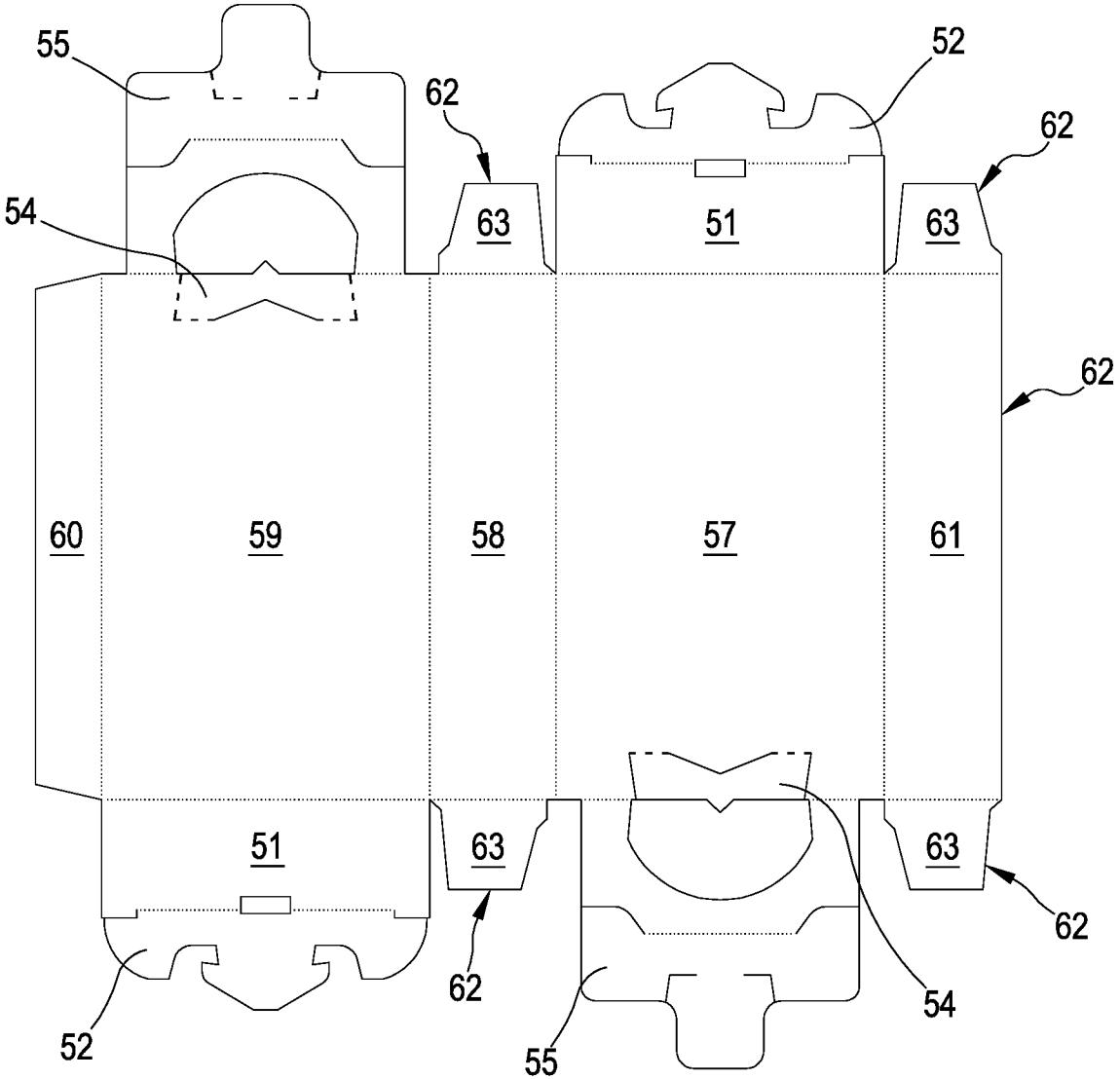
FIG. 12 shows a draft of a container in accordance with the present invention and including said coupling system.
Figure 19:
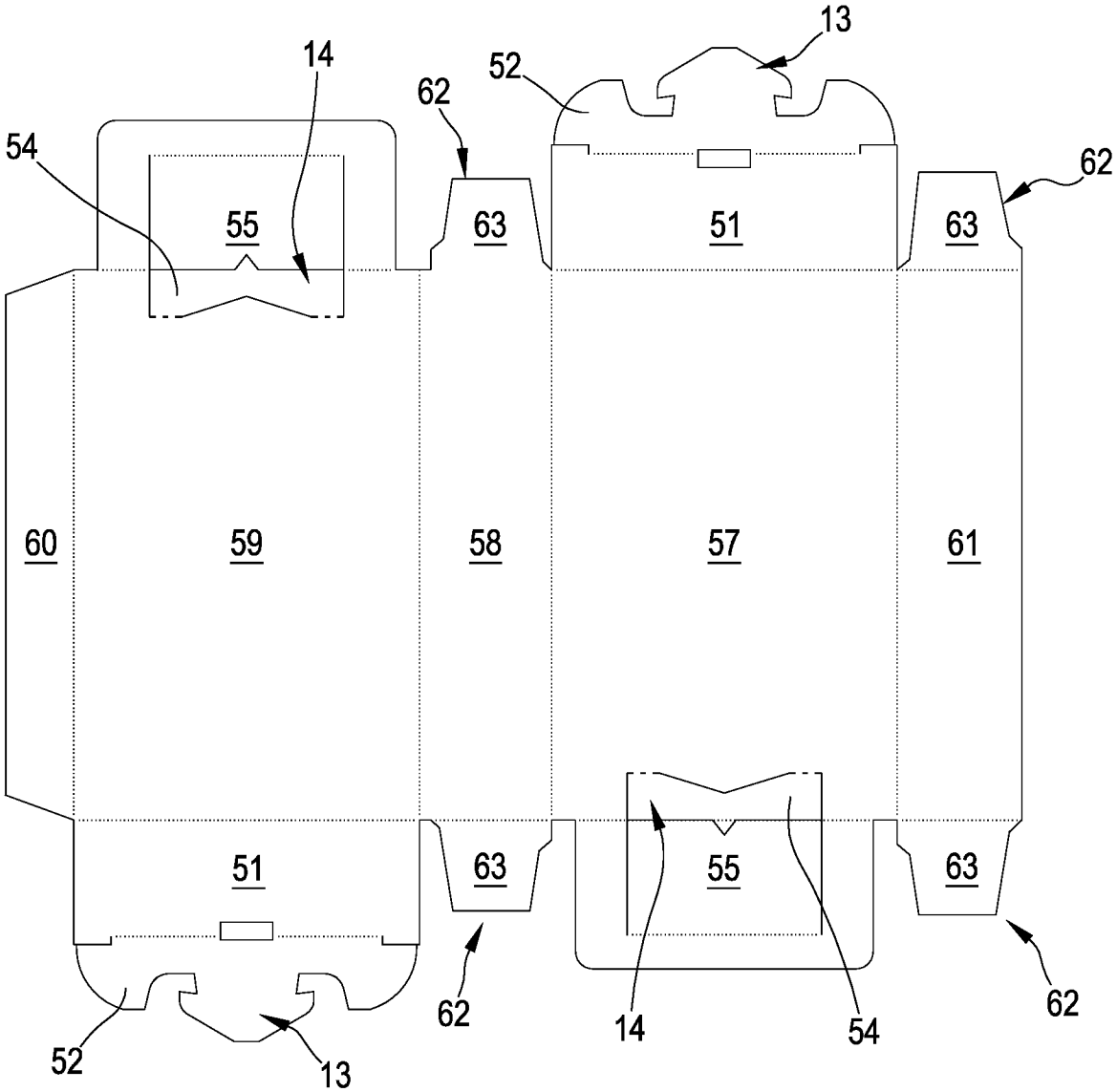
FIG. 19 is a draft of a container including a coupling system in accordance with the present invention.
Figure 20:
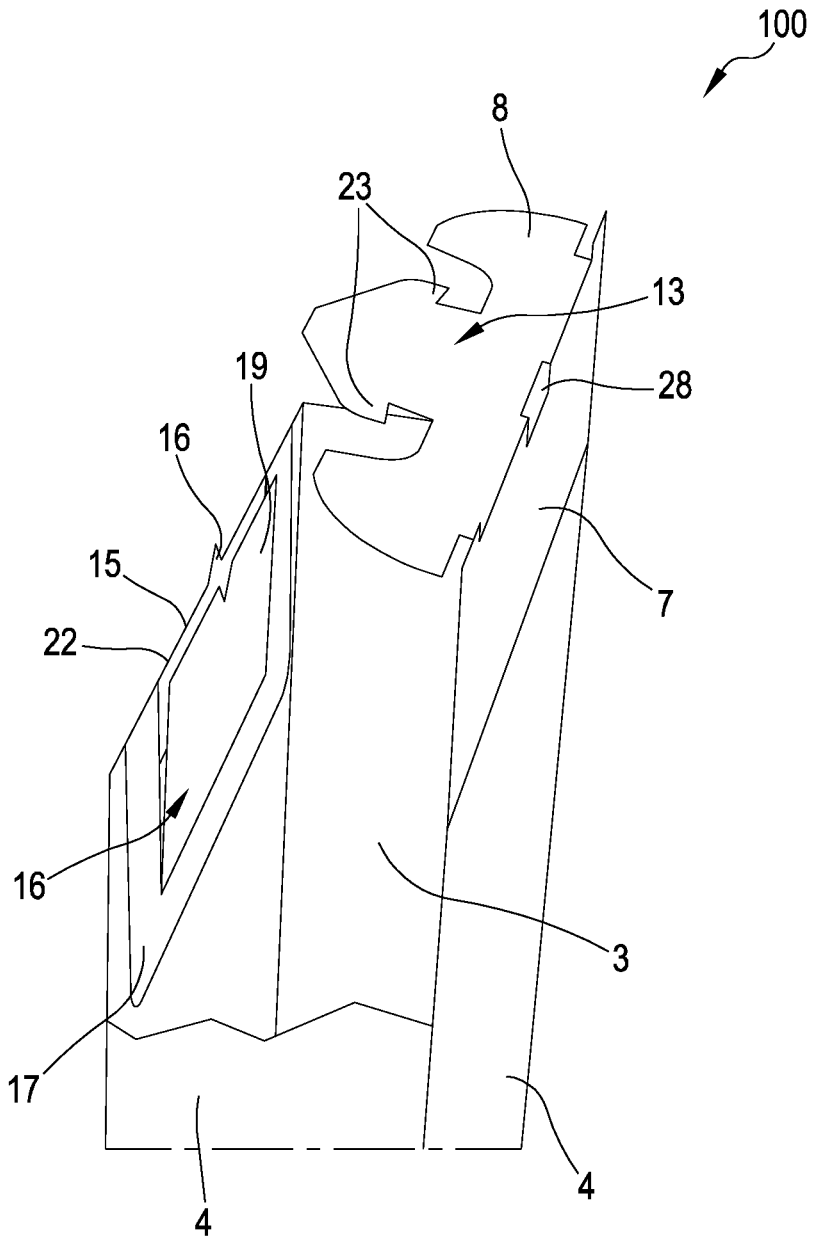
FIG. 20 is a cross-section of a container including the coupling system.
Figure 22:
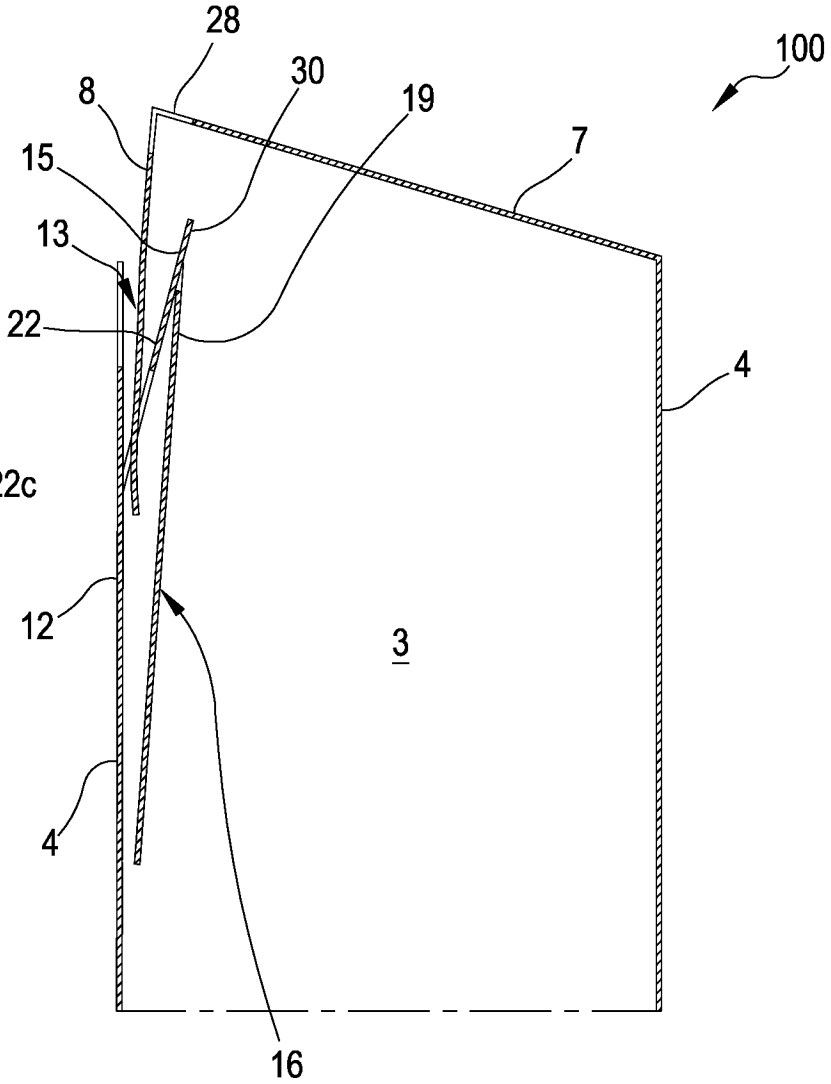
FIG. 22 is a section, taken along the line XXI-XXI, of the container of FIG. 21.

The first base portion 11 and the first coupling portion 13 are borne by the free edge 6 of the storage 2 and are rotatably movable with respect to the latter. Furthermore, the second base portion 12, jointly with the second coupling portion 14 define at least part of a lateral wall 4 of the storage 2. As shown in FIGS. 12 and 19, the step of preparing the storage 2 includes a step of preparing a sixth sheet 56 including at least one first and one second portion 57, 59 interconnected with a central connecting portion 58. The sixth sheet 56 further includes at least one first and one second lateral connecting portion 60, 61, in which the central connecting portion 58 is interposed between the first and the second portion 57, 59, the first portion 57 is interposed between the first lateral connecting portion 61 and the central connecting portion 58, the second portion 59 is interposed between the second lateral connecting portion 60 and the central connecting portion 58. Each of the portions 57, 58, 59, 60, 61 include at least two opposite longitudinal edges and two opposite end edges. The first and second portions 57, 59, the central connecting portion 58 and the lateral connecting portions 60, 61 are joined along the longitudinal edges and aligned along a single connection direction.

The step of preparing the storage 2 further includes a step of folding the sixth sheet 56 (not shown in the accompanying Figures), joining the lateral connecting portions 60, 61, to form the storage 2 exhibiting the passage opening 5 delimited by at least one free edge 6. The lateral connecting portions 60, 61 are joined to each other by means of adhesive material.

The step of preparing the storage 2 further includes the step of preparing a seventh sheet 62 exhibiting at least one portion 63 connected to at least one central and/or lateral connecting portion of the sixth sheet 56 and emerging with respect to the latter, in particular, emerging from at least one end edge of the sixth sheet 56. The portion 63 of the seventh sheet 62 is adapted to form a resting portion 80 of the container 100.

The step of preparing the storage 2 includes a step of folding the first base portion 11 and the first coupling portion 13 of the first and second sheets 51, 52 to form, respectively, the closing portion 7 and the inserting portion 8 of the closing tab 9 of the container 100. The third sheet 53 defining the second base portion 12 of the second coupling portion 14 of the coupling system 1 is integrally joined to form a single body with the first portion 57 and/or second portion 59 of the sixth sheet 56. The first sheet 51 defining the first base portion 11 of the coupling system 1 is integrally joined to form a single body with the first portion 57 and/or with the second portion 59 of the sixth sheet 56, in particular in which the first sheet 51 emerges from the end edges of the sixth sheet 56.

The first, second, third, fourth, fifth, sixth, and seventh sheet may be integrally joined to one another defining a single body of sheet material, in particular of paper sheet material.

Process for Arming the Coupling System 1

Furthermore, it is an object of the present invention a process for the arming of the tamper-evident coupling system 1, in accordance with one or more of the accompanying claims and/or in accordance with the above detailed description.

The arming process, diagrammatically shown in FIGS. 5A-B, 8-9, 21-24, includes a step of separately preparing the first coupling portion 13 and the second coupling portion 14 and a further step of exerting a mutual pressure between the first and the second coupling portions 13, 14 defining an initial contact condition of the coupling system 1. Such process, including the step of engaging the first and the second coupling portions 13, 14 defining the arming condition.

Figure 21:
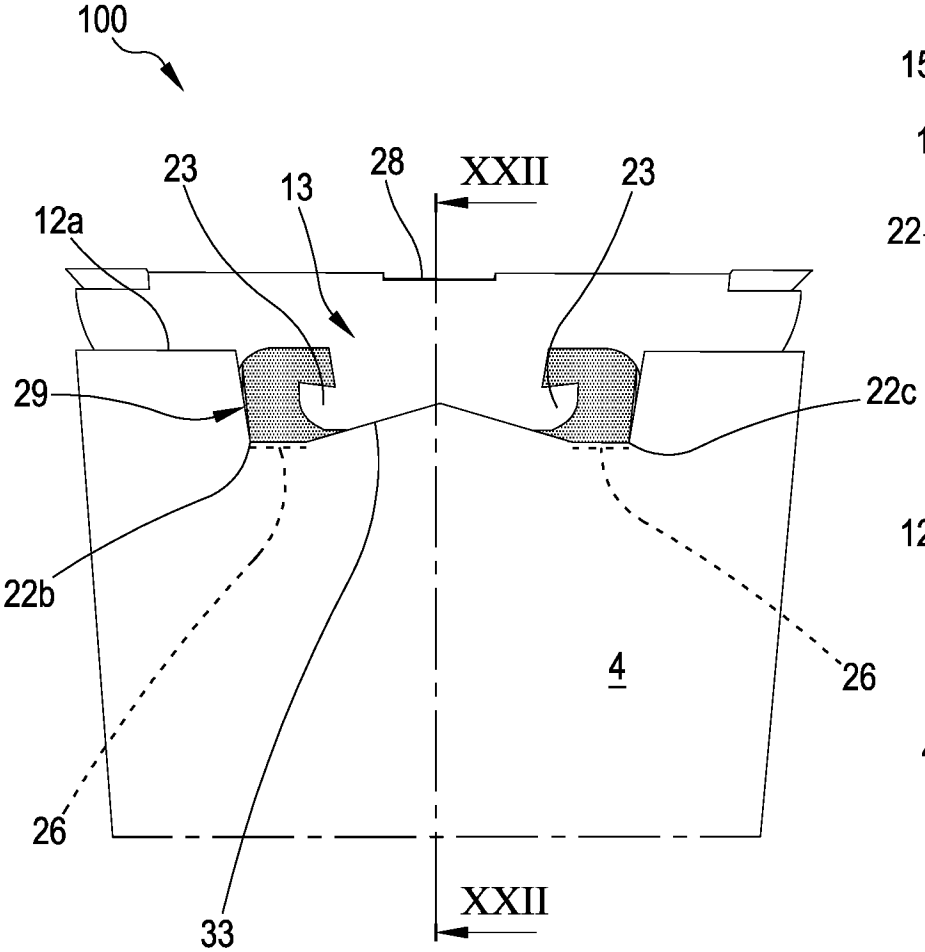
FIG. 21 shows an initial closing step of a container including a coupling system in accordance with the present invention.

The step of exerting a mutual pressure between the first and the second coupling portions 13, 14 includes a sub-step of nearing the respective hook 23 of the first coupling portion 13 to the hook 22 of the second coupling portion 14, and of putting in contact, optionally pressing, the respective hook 23 of the first coupling portion 13 at the hook 22 of the second coupling portion 14. As shown in FIGS. 5B and 21, the first coupling portion 13, during the step of exerting a mutual pressure, is interposed between the hook 22 of the second coupling portion 14 and at least part of the second base portion 12, in particular, the first coupling portion 13 is inserted into the passage 32 defined by the gripping edge 22*a* of the hook 22 of the second coupling portion 14 and part of the cut edge 33 of the through cavity 29. The step of exerting a mutual pressure between the first and the second coupling portions 13, 14 includes a step in which the pressing portion 19 receives against it, to sustain it, the hook 22 of the second coupling portion 14. The latter step corresponds to the holding operating condition of the supporting portion 16 (see sections of FIGS. 7 and 22). The step of engaging the first and the second coupling portions 13, 14 includes the steps of inserting the respective hook 23 of the first coupling portion 13 at the gripping edge 22*a* of the hook 22 of the second coupling portion 14, and of defining the grip between the undercut portions of the first and of the second coupling portion 13, 14 respectively delimited by the gripping edges 23*a*, 22*a*. The latter step corresponds to the releasing operating condition, in particular in which the total or partial breaking of the weakening portion 24 of the supporting portion 16 occurs, enabling an upper movement of the hook 22 of the second coupling portion 14 with respect to the holding operating condition (see sections of FIGS. 9 and 24).

Use of the Coupling System 1

Figure 14:
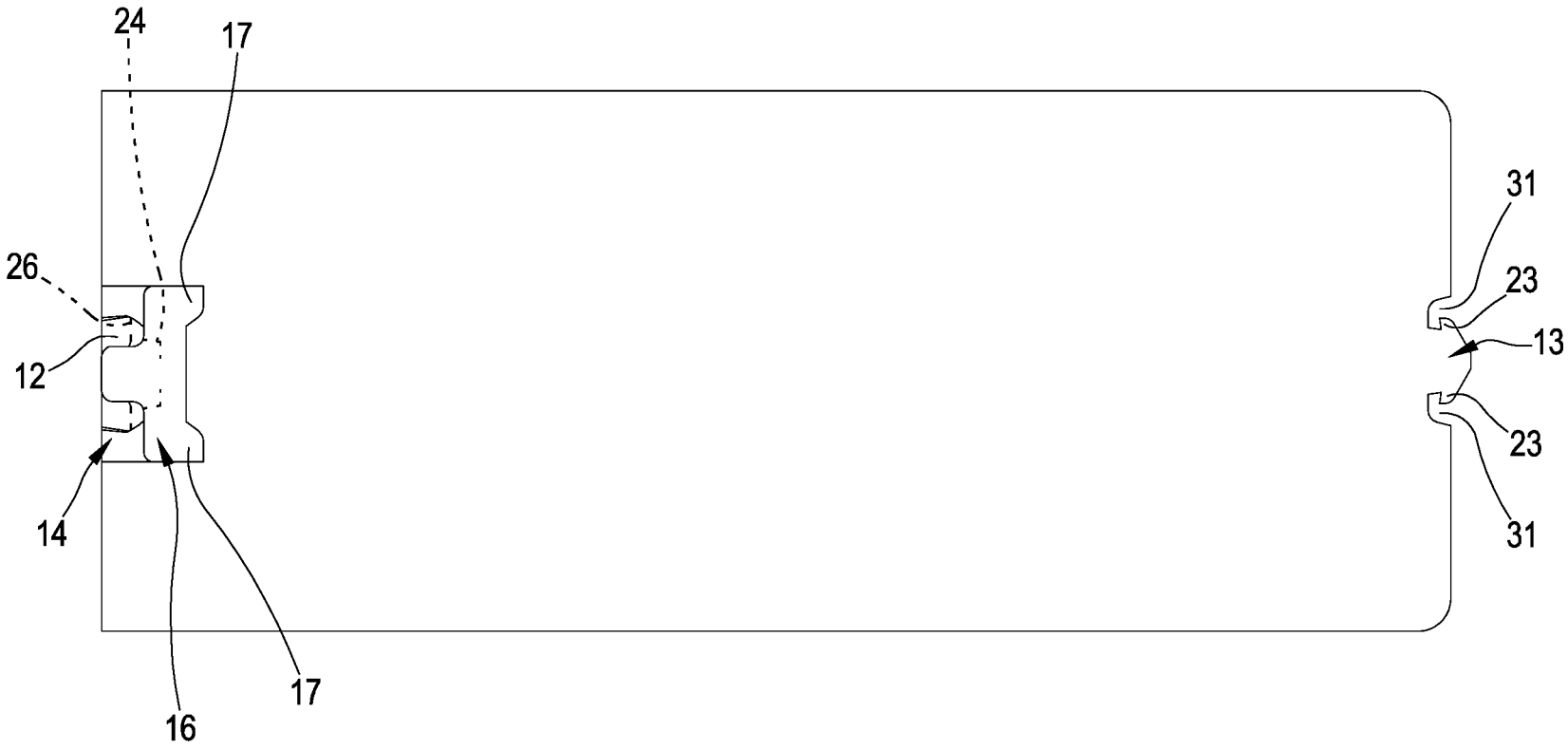
FIGS. 14-16 diagrammatically show bands or envelopes including the coupling system in accordance with the present invention.
Figure 15:
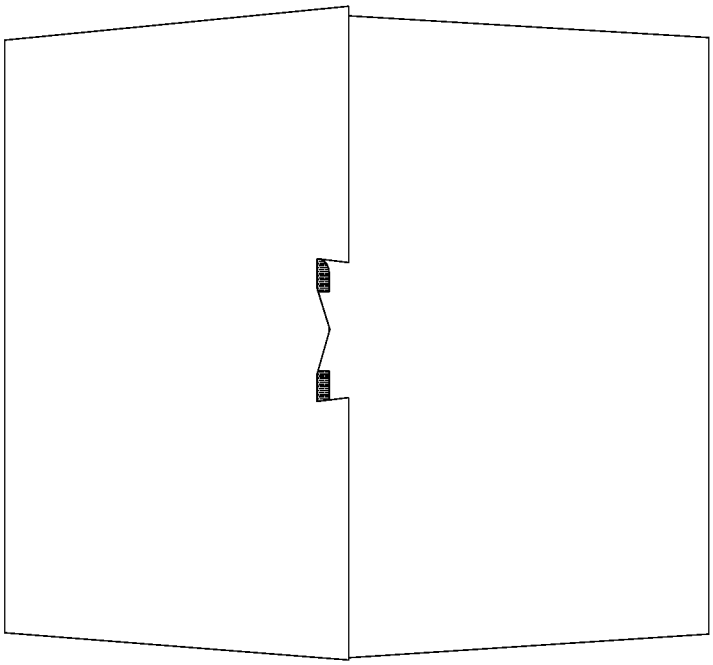

Furthermore, it is an object of the present invention a use of the tamper-evident coupling system 1, in accordance with one or more of the accompanying claims and/or in accordance with the above detailed description. The using process provides for the employment of the coupling system 1 to define at least one selected from the group of:

a container for the containment of one or more products in which the coupling system 1 is used to define a first closed condition of the container. The coupling system 1 is configured for defining a first open condition under which the breaking of the removable portion 15 occurs, so as to show a possible tampering of the container;

an envelope (not shown in the accompanying Figures) for the containment of one or more products in which the coupling system 1 is used to define a first closed condition of the envelope. The coupling system 1 is configured for defining a first open condition of the envelope under which the breaking of the removable portion 15 occurs, so as to show a possible tampering of the envelope;

a band, shown in FIGS. 14-16, for wrapping one or more products, in which the coupling system 1—for example borne by end strips opposite to the band—is used to define a first closed condition of the band. The coupling system 1 is further configured for defining a first open condition under which the breaking of the removable portion 15 occurs, so as to show a possible tampering of the band.

What is claimed is:

1. A tamper-evident container, comprising:

a storage housing made of sheet material, defining an internal volume, and configured for housing products, the housing comprising a predetermined number of lateral walls defining a passage opening delimited by a free edge, the passage opening configured for communicating the internal volume of the housing with an external environment, and a tamper-evident coupling system comprising:

a first base portion;

a second base portion;

a first coupling portion supported by and extending from the first base portion;

a second coupling portion supported by the second base portion and configured for cooperating with the first coupling portion, wherein the first and the second coupling portions are configured for defining an arming condition in which the first and second coupling portions are stably engaged with each other, wherein at least one of the first and the second coupling portions comprises a removable portion that is separable from the tamper-evident coupling system upon a first disengagement of the first and second coupling portions following the arming condition to prevent a subsequent coupling between the first and second coupling portions and to show a tampering with the tamper-evident coupling system, wherein the second coupling portion is integrally joined to the second base portion and extends from a perimeter edge of the second base portion, wherein the second coupling portion comprises a hook defining an undercut portion delimited by a gripping edge facing the perimeter edge of the second base portion, and wherein the gripping edge and the perimeter edge cooperatively define a passage configured to receive the first coupling portion for engagement of the first coupling portion with the second coupling portion, wherein the first base portion is rotatably constrained to the free edge of the housing, the first coupling portion being supported by the first base portion such that the first base portion is interposed between the free edge of the housing and the first coupling portion, wherein the first base portion and the first coupling portion are rotatable with respect to the housing between:

a closed condition of the tamper-evident container in which at least a part of the first base portion prevents communication between the internal volume of the housing and the external environment, and an open condition of the tamper-evident container in which the first base portion and the first coupling portion enable the communication between the internal volume and the external environment, wherein the second base portion is integrally joined to a lateral wall of the tamper-evident container, and wherein the second base portion and the second coupling portion of the coupling system together define a single external lateral wall of the storage housing of the tamper-evident container, wherein the hook extends as a prolongation from the perimeter edge of the second base portion defining a single external wall made of a single external sheet, wherein the second coupling portion is struck from the second base portion, wherein the second coupling portion has a first upper edge and the second base portion has a second upper edge, wherein the first and second upper edges are in-line with each other, wherein the coupling system, in a first closed condition of the tamper-evident container, is configured to define the arming condition in which the first and the second coupling portions are engaged with each other, wherein the coupling system, in a first open condition of the tamper-evident container, following the first closed condition, is configured to define a first disengagement condition in which the removable portion is configured to be separated from the coupling system to show a tampering of the coupling system and of the tamper-evident container, wherein the removable portion is defined by the hook of the second coupling portion, the hook being constrained to the perimeter edge of the second base portion by at least one weakening element, wherein the gripping edge of the hook of the second coupling portion defines, cooperatively with the external lateral wall of the storage housing, the passage adapted to receive, when crossed, the first coupling portion for the engagement of the latter with the second coupling portion, and wherein the second base portion comprises a through cavity delimited by a cut edge defined by part of the perimetral edge, wherein the cut edge delimits a depression of the second base portion, and wherein the second coupling portion is at least partially counter-shaped to and arranged inside the depression, wherein the hook of the second coupling portion is engaged, in the arming condition, in the depression.

2. The tamper-evident container according to claim 1, wherein the hook is a first hook, the undercut is a first undercut, and the gripping edge is a first gripping edge, the first coupling portion comprising a second hook defining a second undercut portion delimited by a second gripping edge, and wherein the first and second hooks respectively comprise first and second concavities that face each other in the under the arming condition.

3. The tamper-evident container according to claim 1, wherein the hook of the second coupling portion is constrained to the perimeter edge of the second base portion two weakening elements opposite to each other and symmetric with respect to a mid-axis of the coupling system.

4. The tamper-evident container according to claim 1, wherein the first base portion comprises a display opening configured to display at least part of the removable portion.

5. The tamper-evident container according to claim 4, wherein the display opening is further configured to display the at least one weakening element of the removable portion.

6. The tamper-evident container according to claim 1, wherein the hook of the second coupling portion is engaged directly with the cut edge by at least one weakening element.

7. The tamper-evident container according to claim 1, wherein the cut edge defined by the through cavity comprises an insertion edge which, before the first disengagement condition of the first and second coupling portions, is directly facing the gripping edge of the hook of the second coupling portion, and wherein the insertion edge and the gripping edge of the hook of the second coupling portion, before the first disengagement condition of the first and second coupling portions, define the passage.

8. The tamper-evident container according to claim 1, wherein the tamper-evident coupling system is made of sheet material.

9. The tamper-evident container according to claim 1, wherein the hook of the second coupling portion, while the container is adjusted from the open condition to the first closed condition, is configured for rotating with respect to a lateral wall of the housing according to a direction entering the internal volume of the housing such that the gripping edge of the hook of the second coupling portion and a lateral wall of the housing cooperatively define the passage configured to receive the first coupling portion for engagement of the first coupling portion with the second coupling portion.

* * * * *